US006768878B2

(12) United States Patent
Komatsu et al.

(10) Patent No.: US 6,768,878 B2
(45) Date of Patent: Jul. 27, 2004

(54) IMAGE FORMING METHOD AND IMAGE FORMING APPARATUS UTILIZING A CONTROL PATCH

(75) Inventors: Toru Komatsu, Hachioji (JP); Hirotaka Kabashima, Hachioji (JP); Toru Yamaguchi, Hachioji (JP); Tetsuya Ishikawa, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/277,761

(22) Filed: Oct. 22, 2002

(65) Prior Publication Data

US 2003/0091356 A1 May 15, 2003

(30) Foreign Application Priority Data

Oct. 30, 2001 (JP) ..... 2001-332265
Jan. 15, 2002 (JP) ..... 2002-005890
Feb. 22, 2002 (JP) ..... 2002-046101

(51) Int. Cl.[7] ..... G03G 15/00
(52) U.S. Cl. ..... 399/49; 399/46
(58) Field of Search ..... 399/49, 46, 72

(56) References Cited

U.S. PATENT DOCUMENTS 4,551,005 A * 11/1985 Koichi ..... 399/172
5,250,988 A * 10/1993 Matsuura et al. ..... 399/42
5,950,043 A * 9/1999 Fujita et al. ..... 399/60

FOREIGN PATENT DOCUMENTS

JP 07-137346 5/1995
JP 2000-181155 6/2000

* cited by examiner

*Primary Examiner*—Quana Grainger
(74) *Attorney, Agent, or Firm*—Cantor Colburn LLP

(57) ABSTRACT

An image forming method includes the steps of: forming a plurality of electrostatic latent images of a non-solid control patch by converting a reference input density; detecting a patch potential of each of the plurality of electrostatic latent images; calculating a density value of image data corresponding to a desired patch potential from the detected plurality of patch potentials; detecting a density of each of the plurality of non-solid control patches which has been formed by an imagewise exposure according to the image data of the reference input density obtained by the calculating step; forming an image by controlling an image forming condition in accordance with a detected density signal.

59 Claims, 17 Drawing Sheets

FIG. 7

| T2 - T1 (°C) | NN | NH | NL | HN | HH | HL | LN | LH | LL | NL2 | HL2 |
|---|---|---|---|---|---|---|---|---|---|---|---|
| -15 | 1 | 1 | 2 | 1 | 0 | 1 | 2 | 1 | 4 | 4 | 2 |
| -14 | 1 | 1 | 2 | 1 | 0 | 1 | 2 | 1 | 4 | 4 | 2 |
| -13 | 1 | 1 | 2 | 1 | 0 | 1 | 2 | 1 | 4 | 4 | 2 |
| -12 | 1 | 0 | 2 | 1 | 0 | 1 | 2 | 1 | 3 | 3 | 2 |
| -11 | 1 | 0 | 2 | 1 | 0 | 1 | 2 | 1 | 3 | 3 | 2 |
| -10 | 1 | 0 | 1 | 0 | 0 | 1 | 1 | 1 | 3 | 3 | 1 |
| -9 | 1 | 0 | 1 | 0 | 0 | 1 | 1 | 1 | 2 | 2 | 1 |
| -8 | 0 | 0 | 1 | 0 | 0 | 0 | 1 | 0 | 2 | 2 | 1 |
| -7 | 0 | 0 | 1 | 0 | 0 | 0 | 1 | 0 | 2 | 2 | 1 |
| -6 | 0 | 0 | 1 | 0 | 0 | 0 | 1 | 0 | 1 | 1 | 1 |
| -5 | 0 | 0 | 0 | 0 | 0 | 0 | 0 | 0 | 1 | 1 | 0 |
| -4 | 0 | 0 | 0 | 0 | 0 | 0 | 0 | 0 | 1 | 1 | 0 |
| -3 | 0 | 0 | 0 | 0 | 0 | 0 | 0 | 0 | 0 | 0 | 0 |
| -2 | 0 | 0 | 0 | 0 | 0 | 0 | 0 | 0 | 0 | 0 | 0 |
| -1 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 1 | 0 | 0 | 0 | 0 | 0 | 0 | 0 | 0 | -1 | -1 | 0 |
| 2 | 0 | 0 | 0 | 0 | 0 | 0 | 0 | 0 | -1 | -1 | 0 |
| 3 | 0 | 0 | -1 | 0 | 0 | 0 | -1 | 0 | -2 | -2 | -1 |
| 4 | 0 | 0 | -2 | 0 | 0 | 0 | -2 | 0 | -3 | -3 | -2 |
| 5 | 0 | 0 | -2 | 0 | 0 | 0 | -2 | 0 | -4 | -4 | -2 |
| 6 | 0 | 0 | -3 | 0 | 0 | 0 | -3 | 0 | -4 | -4 | -3 |
| 7 | 0 | 0 | -4 | 0 | 0 | 0 | -4 | 0 | -5 | -5 | -4 |
| 8 | -1 | 0 | -4 | 0 | 0 | -1 | -4 | -1 | -6 | -6 | -4 |
| 9 | -1 | 0 | -5 | 0 | 0 | -1 | -5 | -1 | -7 | -7 | -5 |
| 10 | -1 | 0 | -6 | 0 | 0 | -1 | -6 | -1 | -7 | -7 | -6 |
| 11 | -1 | 0 | -6 | 0 | 0 | -1 | -6 | -1 | -8 | -8 | -6 |
| 12 | -1 | -1 | -7 | -1 | 0 | -1 | -7 | -1 | -9 | -9 | -7 |
| 13 | -1 | -1 | -8 | -1 | 0 | -1 | -8 | -1 | -10 | -10 | -8 |
| 14 | -2 | -1 | -8 | -1 | 0 | -2 | -8 | -2 | -10 | -10 | -8 |
| 15 | -2 | -1 | -9 | -1 | 0 | -2 | -9 | -2 | -11 | -11 | -9 |
| 16 | -2 | -1 | -10 | -1 | 0 | -2 | -10 | -2 | -12 | -12 | -10 |
| 17 | -2 | -1 | -10 | -1 | -1 | -2 | -10 | -2 | -13 | -13 | -10 |
| 18 | -2 | -1 | -11 | -1 | -1 | -2 | -11 | -2 | -13 | -13 | -11 |
| 19 | -2 | -1 | -12 | -1 | -1 | -2 | -12 | -2 | -14 | -14 | -12 |
| 20 | -3 | -1 | -12 | -1 | -1 | -3 | -12 | -3 | -15 | -15 | -12 |
| 21 | -3 | -1 | -13 | -1 | -1 | -3 | -13 | -3 | -16 | -16 | -13 |
| 22 | -3 | -1 | -14 | -1 | -1 | -3 | -14 | -3 | -16 | -16 | -14 |
| 23 | -3 | -2 | -14 | -2 | -1 | -3 | -14 | -3 | -17 | -17 | -14 |
| 24 | -3 | -2 | -15 | -2 | -1 | -3 | -15 | -3 | -18 | -18 | -15 |
| 25 | -3 | -2 | -16 | -2 | -1 | -3 | -16 | -3 | -19 | -19 | -16 |

128

152

176

200

224

255

128

152

176

200

224

255

IMAGE FORMING METHOD AND IMAGE FORMING APPARATUS UTILIZING A CONTROL PATCH

BACKGROUND OF THE INVENTION

The present invention relates to an image forming method and an image forming apparatus, both to form images electrophotographically on recording paper by controlling image forming conditions, and more particularly to image density control technology.

For a conventional image forming apparatus, such as copying machine or printer, that has a developing device constructed so that a latent image formed on its photoreceptor is developed using a two-component developing agent consisting of toner and carrier, an image density control method is employed in which the toner concentration in the developing agent is maintained by replenishing toner according to the amount of toner which has been consumed during the development.

The above-mentioned toner addition is controlled so as to be performed when a decrease in toner concentration is detected by, for example, detecting the resistance or permeability of the developing agent.

With this conventional method, however, there is a limit to supplying high-quality images stably over long periods of time, because detection errors are prone and partly because changes in the developing performance of the developing agent cannot be properly accommodated.

There is a method of controlling image forming conditions to avoid such inconveniences in image density control as described above. That is to say, this method forms a control patch on the photoreceptor, then detects the image density of the control patch by use of a density detection means, and controls image forming conditions using the detection signal sent from the density detection means.

Image density control using this method has the characteristic that since the image density of the image actually formed is constantly maintained, almost no control errors basically occur.

With regard to such image density control, the applicant for the present patent performed several proposals in Unexamined Japanese Application Patent Laid-Open Publications Nos. Hei 07-137346 and 2000-181155.

Under this image density control method, a control patch is formed on an image forming body such as a photoreceptor in accordance with image data of a reference density, then the image density of the formed control patch is detected using an image density detection means, and the quantity of electric charge, the exposure amount, the developing bias, the developing agent carrying velocity, the concentration of the toner in the developing agent, and other image forming conditions are controlled using the detection signal sent from the image density detection means.

Under prior art, a control patch is formed on an image forming body such as a photoreceptor in accordance with the image data relating to reference density, then the image density of the formed control patch is detected using an image density detection means, and the quantity of electric charge, the exposure amount, the developing bias, the developing agent carrying velocity, the toner concentration in the developing agent, and other image forming conditions are controlled using the detection signal sent from the image density detection means.

In this case, a patch that has been formed as an image of the required density by varying the developing bias and the charging potential is usually used as a reference control patch. However, since it is difficult with the above-mentioned control method to respond to the tendencies towards faster image formation and toner particle size reduction in recent years, the formation of a dither pattern and an error diffusion pattern for imagewise exposure based on reference input density image data, or of solid and non-solid reference patterns with densities adjusted by laser pulse width modulation has been proposed. Hereby, although, heretofore, the developing field has been reduced by reducing the developing bias voltage in order to obtain a patch image with almost the maximum density, a patch image that stably changes in density can be obtained using the method proposed above.

Even when a control patch is formed by imagewise exposure based on image data of a reference input density, since changes in the sensitivity of the photoreceptor, associated with changes in the temperature and humidity of the ambient environment, and the deterioration in the characteristics of the developing agent change the quality of the control patch formed, a control patch more stable in image density must be formed to provide optimal control of the image forming conditions.

In the meantime, although, as described above, the image density control method using a control patch is useful technology, it has become clear that this method poses problems associated particularly with the image formation in which the image forming rate is increased or toner is reduced in particle size, such as polymerized toner, is used.

For example, during a continuous image forming process, although a control patch is formed in both the leading image area and the following image area, it is difficult to make setting of the image forming conditions for the control patch follow the progress of the image forming process.

More specifically, although the conventional formation of a control patch has been reducing the developing bias voltage value and charging potential value during the normal image forming process, there have occurred the problems that the slow response speeds of the charging device and developing bias power supply have resulted in the control patch becoming unstable in density or the end portion of the normal image area being becoming uneven in density.

Also, although the conventional control patch is formed as an image of uniform density (generally called "solid image"), since the solid image is not stable against changes in image forming conditions and suffers changes in the density of the control patch due to time-varying changes in the developing performance of the developing agent, the conventional control method has the problem that although it basically is useful density control technology, it reduces the control accuracy of the image forming conditions for normal image formation.

Accordingly, there arises the problem that when the density detection means detects a decrease in the density of the control patch below the required value due to an extended time of use of the developing agent, since an excessive amount of toner will be added, image density will increase too significantly and the toner will scatter.

Such a discrepancy between the density of the control patch and that of the image actually formed is particularly significant in the case of using polymerized toner.

In order to solve the above new problems, the present inventors have improved the control of image forming conditions, based on the formation of a control patch of stable density, by dither-patterning the above-mentioned control patch.

However, even under the configuration that uses a control patch of stable density, since changes in the sensitivity of the image forming body according to ambient temperature and humidity or changes in the characteristics of the developing agent also change, although slightly, the density of the control patch, it has been found that density control technology still admits of improvement.

SUMMARY OF THE INVENTION

The first object of the present invention is to supply an image forming method, and an image forming apparatus, by which the optimal density of a control patch not affected by changes in the sensitivity of the image forming body or changes in the response characteristics of writing light according to the particular type of exposure means can be obtained and thus the formation of images with stable image density can be maintained over long periods of time.

The second object of the present invention is to supply an image forming method, and an image forming apparatus, by which a control patch of image density can be stably formed to control image forming conditions either during the warming-up time following the power-on sequence of the image forming apparatus or after the required number of images have been printed.

The third object of the present invention is to supply an image forming apparatus constructed so that a control patch of image density is stably formed after replacement, adjustment, or other maintenance operations of an exposure device used to form a latent image using the image forming apparatus.

The above objects can be achieved by adopting either one of the following structures (1) to (57):

(1) An image forming method by which the formation of an image is accomplished by detecting the density of a control patch which has been formed by exposure based on image data of reference input density, and controlling image forming conditions in accordance with the corresponding detection signal, wherein the image forming method is characterized in that the control patch consists of a dither pattern.

(2) The image forming method in Structure (1) above, characterized in that the reference input density for forming the dither pattern is changed according to the particular environmental parameters.

(3) The image forming method in Structure (1) or (2) above, characterized in that the reference input density for forming the dither pattern is changed according to the quantity of image formation.

(4) The image forming method in either of Structures (1) to (3) above, characterized in that the reference input density for forming the dither pattern is changed according to the particular stirring period of time of the developing agent.

(5) The image forming method in either of Structures (1) to (4) above, characterized in that the developing agent carrying velocity of the developing agent carrying body is made variable, and in that after the reference value of the developing agent carrying velocity has been set, when the developing agent carrying velocity is less than the reference value, image density adjustment is accomplished by changing the developing agent carrying velocity, and when the developing agent carrying velocity reaches the reference value, image density adjustment is accomplished by replenishing the developing device with toner.

(6) The image forming method in either of Structures (1) to (5) above, characterized in that polymerized toner is used for development.

(7) An image forming apparatus comprising an image forming body, a latent image forming means that forms an electrostatic latent image on the image forming body in accordance with image data, a developing means having a developing agent carrying body that forms a toner image by developing the electrostatic latent image formed on the image forming body, a toner replenishment means for replenishing toner to the developing means, an image density detection means for detecting the image density of the toner image formed on the image forming body, and a control means, wherein the image forming apparatus is characterized in that the control means forms a control patch on the image forming body by controlling the latent image forming means and thus controls image forming conditions in accordance with the output of the image density detection means which has detected the image density of the control patch, and in that a patch consisting of a non-solid pattern is used as the control patch.

(8) The image forming apparatus in Structure (7) above, characterized in that when the developing agent carrying velocity is less than its reference value, the control means executes the first image density control to adjust the developing agent carrying velocity of the developing agent carrying body, and when the developing agent carrying velocity reaches the reference value, the control means executes the second image density control for toner replenishment of the toner replenishment means without adjusting the developing agent carrying velocity.

(9) The image forming apparatus in Structure (7) or (8) above, characterized in that the density value of the image data for forming the non-solid pattern is changed according to the particular environmental parameters.

(10) The image forming apparatus in either of Structures (7) to (9) above, characterized in that the density value of the image data for forming the non-solid pattern is changed according to the particular quantity of image formation.

(11) The image forming apparatus in either of Structures (7) to (10) above, characterized in that the density value of the image data for forming the non-solid pattern is changed according to the particular stirring time of the developing agent.

(12) An image forming method by which image density control A executed before or after an image forming process, and image density control B executed during the image forming process are conducted in accordance with the detection results relating to the image density of a control patch which has been formed on an image forming body, wherein the image forming method is characterized in that a non-solid pattern is used as the control patch.

(13) The image forming method in Structure (12) above, characterized in that the image density control A is conducted when power is supplied to the image forming apparatus.

(14) The image forming method in Structure (12) or (13) above, characterized in that the image density control A is conducted at fixed time intervals under a stand-by status.

(15) The image forming method in either of Structures (12) to (14) above, characterized in that the image density control A is conducted at each required time.

(16) The image forming method in either of Structures (12) to (15) above, characterized in that image density detection of the control patch under the image density control A, and image density control of the control patch under the image density control B are conducted by one image density detection means.

(17) The image forming method in either of Structures (12) to (16) above, characterized in that during the image density control B, toner is replenished each time the predetermined number of images is formed.

(18) The image forming method in either of Structures (12) to (17) above, characterized in that polymerized toner is used for development.

(19) An image forming apparatus comprising an image forming body, a latent image forming means that forms an electrostatic latent image on the image forming body in accordance with image data, a developing means having a developing agent carrying body and to form a toner image by developing the electrostatic latent image formed on the image forming body, a toner replenishment means for replenishing the developing means with toner, an image density detection means for detecting the image density of the toner image formed on the image forming body, and a control means, wherein the image forming apparatus is characterized in that when image density control A executed before or after an image forming process, and image density control B executed during the image forming process are conducted, the control means forms the control patch consisting of a non-solid pattern.

(20) The image forming apparatus in Structure (19) above, characterized in that when power is supplied to the image forming apparatus, the control means executes the image density control A.

(21) The image forming apparatus in Structure (19) or (20) above, characterized in that the control means executes the image density control A at fixed time intervals under a stand-by status.

(22) The image forming apparatus in either of Structures (19) to (21) above, characterized in that the control means executes the image density control A at each required time.

(23) The image forming apparatus in either of Structures (19) to (22) above, characterized in that during the image density control B, the control means functions to replenish toner each time a predetermined number of images is formed.

(24) An image forming method by which the formation of an image is accomplished by detecting the density of a control patch formed by exposure based on image data of reference input density, and controlling the image forming conditions in accordance with the corresponding detection signal, wherein the image forming method is characterized in that the control patch composed of a non-solid pattern is used and, in that latent images are formed by converting image data having reference input densities different from each other, then the potentials of the plurality of patches on which the electrostatic latent images have been formed are detected, and the single density value of the image data corresponding to the desired patch potential is calculated from all detected patch potentials.

(25) The image forming method in Structure (24) above, characterized in that the reference input density to be used to form the non-solid pattern is changed according to the particular environmental parameters.

(26) The image forming method in either of Structure (24) or (25) above, characterized in that the density value of the image data for forming the non-solid pattern is changed according to the particular quantity of image formation.

(27) The image forming method in either of Structures (24) to (26) above, characterized in that the density value of the image data for forming the non-solid pattern is changed according to the particular stirring period of time of the developing agent.

(28) The image forming method in either of Structures (24) to (27) above, characterized in that the calculation of the density value of the image data corresponding to the desired patch is performed each time a predetermined number of images is formed.

(29) The image forming method in either of Structures (24) to (28) above, characterized in that the calculation of the density value of the image data corresponding to the desired patch is performed for each predetermined period of developing agent stirring time.

(30) An image forming method comprising the process of conducting imagewise exposure of a solid patch on the image forming body which has been electrically charged to a potential VH by a charging device and performing potential adjustments between the latent image potential VL of the solid patch and a developing bias VB, the process of forming a plurality of non-solid control patches on the image forming body by modifying image data, and the process of detecting the potential of each non-solid patch by use of a potential sensor and performing arithmetic operations to obtain the desired patch potential, and characterized in that an image can be formed by detecting the derived density of the non-solid patch and controlling image forming conditions using the resulting detection signal.

(31) An image forming apparatus comprising an image forming body, an electrical charging means for charging the image forming body, an imagewise exposure means for conducting imagewise exposure based on image data and enabling the adjustment of the amount of light necessary to form an electrostatic latent image on the image forming body, a potential measuring means for measuring the potential of the image forming body, a developing means having a developing agent carrying body and to form a toner image by applying a developing bias and reversal-developing the electrostatic latent image on the image forming body, an image density detection means for detecting the image density of the toner image formed on the image forming body, and a control means, and characterized in that the control means forms an image using either one of the image forming method set forth in Structure (30).

(32) An image forming apparatus comprising an image forming body, an electrical charging means for charging the image forming body, an imagewise exposure means for conducting imagewise exposure based on image data and enabling the adjustment of the amount of light necessary to form an electrostatic latent image on the image forming body, a potential measuring means for measuring the potential of the image forming body, a developing means having a developing agent carrying body for forming a toner image by applying a developing bias and reversal-developing the electrostatic latent image on the image forming body, an image density detection means for detecting the image density of the toner image formed on the image forming body, and a control means, and characterized in that immediately after changing the intensity of the imagewise exposure means, the control means forms an image using either of the image forming method set forth in Structure (30).

(33) An image forming method comprising the process of forming latent images of a plurality of control patches on an image forming body by use of writing light based on a plurality of sets of image data mutually different in reference input density, the process of measuring the latent image potentials of the control patches by use of a potential detection means, and the process of performing arithmetic operations on the relationship between each latent image potential mentioned above and each reference input density mentioned above and then deriving the density (P1) of the control patch that becomes the required latent image potential, while at the same time storing the results into a storage means, and to form an image by controlling image forming conditions in accordance with the density detection signal generated after development of the control patch having the density (P1), wherein the image forming method is characterized in that the temperature (T1) of the image forming body during arithmetic operations is detected by a temperature detection means and stored into a storage means and in that when the temperature of the image forming body during the formation of the control patch having the density (P1) is changing with respect to the temperature (T1), the density (P1) of the corresponding control patch is changed according to the particular amount of change in the temperature of the image forming body.

(34) The image forming method in Structure (33) above, characterized in that the control patch consists of a dither pattern.

(35) The image forming method in Structure (33), characterized in that the control patch consists of an error diffusion pattern.

(36) The image forming method in Structure (33), characterized in that the control patch consists of a laser pulse width modulation pattern.

(37) The image forming method in Structure (33), characterized in that the density of the control patch that is changed according to the particular change in temperature is further changed according to the particular changes in environmental conditions.

(38) An image forming method comprising the process of forming latent images of a plurality of control patches on an image forming body by use of writing light based on a plurality of sets of image data mutually different in reference input density, the process of measuring the latent image potentials of the control patches by use of a potential detection means, and the process of performing arithmetic operations on the relationship between each latent image potential mentioned above and each reference input density mentioned above and then deriving the density (P1) of the control patch that becomes the required latent image potential, while at the same time storing the results into a storage means, and to form an image by controlling image forming conditions in accordance with the density detection signal generated after development of the control patch having the density (P1), wherein the image forming method is characterized in that the threshold data to be used for the arithmetic operations is changed according to the sensitivity of the image forming body that has been stored into a storage means beforehand.

(39) The image forming method in Structure (38), wherein the control patch is characterized in that it consists of a dither pattern.

(40) The image forming method in Structure (38), wherein the control patch is characterized in that it consists of an error diffusion pattern.

(41) The image forming method in Structure (38), wherein the control patch is characterized in that it consists of a laser pulse width modulation pattern.

(42) The image forming method in Structure (38), characterized in that the threshold data to be used to derive the density of the control patch is changed according to the particular changes in environmental conditions.

(43) The image forming method in Structure (38), characterized in that the threshold data to be used to derive the density of the control patch is changed according to the number of sheets to be printed.

(44) The image forming method in Structure (38), characterized in that the threshold data to be used to derive the density of the control patch is changed according to the particular stirring period of time of the developing agent.

(45) An image forming method comprising the process of forming latent images of a plurality of control patches on an image forming body by use of writing light based on a plurality of sets of image data mutually different in reference input density, the process of measuring the latent image potentials of the control patches by use of a potential detection means, and the process of performing arithmetic operations on the relationship between each latent image potential mentioned above and each reference input density mentioned above and then deriving the density (P1) of the control patch that becomes the required latent image potential, while at the same time storing the results into a storage means, and to form an image by controlling image forming conditions in accordance with the density detection signal generated after development of the control patch having the density (P1), wherein the image forming method is characterized in that the threshold data to be used for the arithmetic operations is changed according to the response characteristics of the writing light that have been stored into a storage means beforehand.

(46) The image forming method in Structure (45), characterized in that the control patch consists of a dither pattern.

(47) The image forming method in Structure (45), characterized in that the control patch consists of an error diffusion pattern.

(48) The image forming method in Structure (45), characterized in that the control patch consists of a laser pulse width modulation pattern.

(49) The image forming method in Structure (45), characterized in that the threshold data to be used to derive the density of the control patch is changed according to the particular changes in environmental conditions.

(50) The image forming method in Structure (45), characterized in that the threshold data to be used to derive the density of the control patch is changed according to the number of sheets to be printed.

(51) The image forming method in Structure (45), characterized in that the threshold data to be used to derive the density of the control patch is changed according to the particular stirring period of time of the developing agent.

(52) The image forming method in either Structure (33), (38), or (45), characterized in that polymerized toner is used for development.

(53) An image forming apparatus comprising a latent image forming means that forms latent images of a plurality of control patches on the image forming body in accordance with a plurality of sets of image data mutually different in reference input density, a potential detection means for detecting the latent image potentials of the control patches, an arithmetic operating means for performing arithmetic operations on the relationship between each latent image potential mentioned above and each reference input density mentioned above and then deriving the density (P1) of the control patch that becomes the required latent image potential, a storage means into which the control patch having the derived density (P1) is stored, a temperature detection means for detecting the temperature (T1) of the image forming body during arithmetic operations, a storage means into which the temperature that has been detected by the temperature detection means is stored, a developing means having a developing agent carrying body and to form a toner image by developing a latent image of the control patch formed on the image forming body, and a density detection means for detecting the density of the toner image of the control patch that has been developed, and a control means, wherein the image forming apparatus is characterized in that it can control image forming conditions by first judging whether the temperature (T1) of the image forming body during the formation of the control patch in copy sequence mode is changing with respect to the temperature (T1) of the image forming body during arithmetic operations on the density of the control patch, next changing the density (P1) of the control patch according to the particular difference between the above temperatures, then developing the latent image that has been exposed to light so as to achieve the optimal patch density, and finally, receiving the density signal corresponding to the control patch toner image density detected by the density detection means.

(54) The image forming apparatus in Structure (53) above, characterized in that the control patch consists of either one of a dither pattern, an error diffusion pattern, and a laser pulse width modulation pattern.

(55) The image forming apparatus in Structure (53), characterized in that a storage means that contains the sensitivity of the image forming body beforehand is provided, in that the threshold data to be used for the arithmetic operations performed to derive the density of the control patch is changed according to the sensitivity of the image forming body that has been stored into the storage means, and in that the corresponding arithmetic operations are performed by the arithmetic operating means.

(56) The image forming apparatus in Structure (53), characterized in that a storage means that contains beforehand the response characteristics of the writing light of the writing means which constitutes the latent image forming means is provided, in that the threshold data to be used for the arithmetic operations performed to derive the density of the control patch is changed according to the response characteristics of the writing light that have been stored into the storage means, and in that the corresponding arithmetic operations are performed by the arithmetic operating means.

(57) The image forming apparatus in Structure (53), characterized in that polymerized toner is used for the development.

BRIEF DESCRIPTION OF THE DRAWINGS

FIG. 7 is a correction diagram representing the relationship between the temperature difference and the amount of change (the amount of correction), established when the density of the control patch consisting of a dither pattern is changed (corrected);

DETAILED DESCRIPTION OF THE PREFERRED EMBODIMENTS

An Embodiment 1 of the present invention will be explained with reference to drawings as follows.

Figure 1:
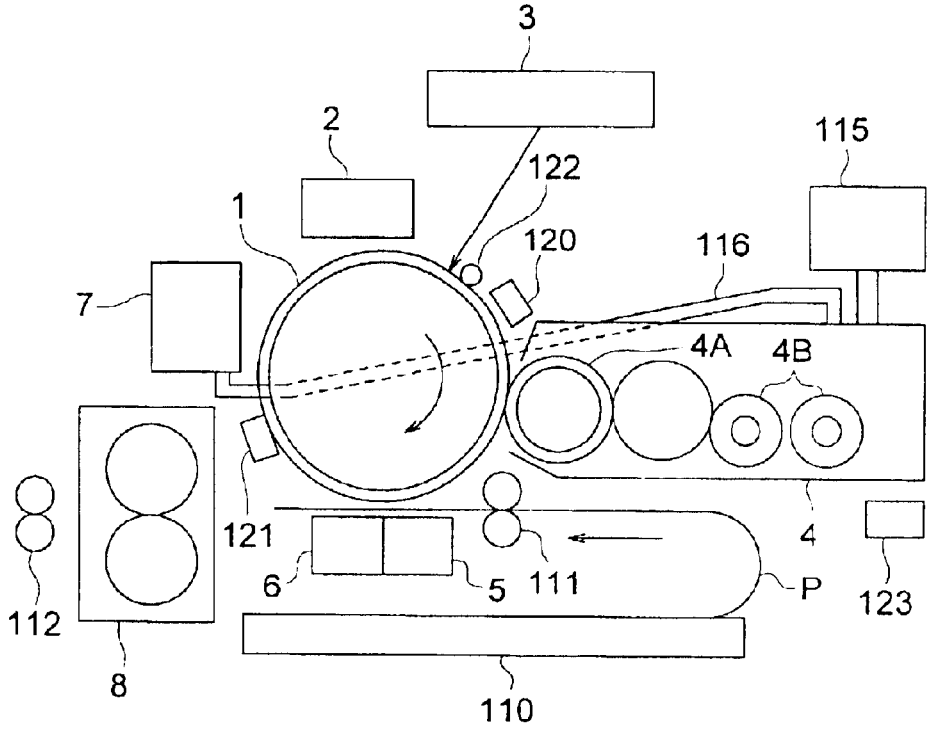
FIG. 1 is an explanatory diagram epitomizing the total configuration of the image forming apparatus.

FIG. 1 is an explanatory diagram epitomizing the total configuration of the image forming apparatus.

A photoreceptor 1 as the image forming body rotated clockwise, is uniformly charged by a charging device 2 of the scorotron scheme, and an electrostatic latent image (hereinafter, referred to simply as a latent image) is formed on the above-mentioned photoreceptor 1 by the dot exposure corresponding to the image data of an exposure device 3 equipped with a semiconductor laser light source.

The aforementioned charging device 2 and exposure device 3 constitute a latent image forming means.

The latent image that has been formed on the aforementioned photoreceptor 1 is developed to become a visible toner image, by a developing device 4 that functions as the developing means for conducting reversal development using a two-component developing agent.

The aforementioned developing device 4 has a rotatable developing sleeve 4A that functions as a developing agent carrying body, and two stirring screws 4B that constitute a developing agent stirring means. A magnet (not shown in the figure) that magnetically attracts the developing agent onto the surface of the developing sleeve 4A is contained at a fixed position therein.

The above-mentioned toner image is transferred to recording paper P by a transferring device 5, and fixed to the recording paper P by a fixing device 8. The recording paper P is made of, for example, plain paper.

After the fixing process, the recording paper P is ejected from the main unit of the apparatus by ejection rollers 112.

A storage section 110 contains a multitude of sheets of recording paper P, each sheet of which is independently unloaded according to control associated with image formation, and then sent to a specific transfer position in the transferring device 5 so that the sheet is superimposed on the toner image existing on the photoreceptor 1 through the resist roller 111.

After the transfer, the recording paper P is separated from the photoreceptor 1 by a separating device 6, then fed to the fixing device 8, and ejected as described above.

Numeral 7 denotes the cleaning device for cleaning the photoreceptor 1 after the transfer.

Numeral 115 denotes the toner replenishing device for replenishing toner with the developing device 4. Numeral 116 denotes a toner recycling device by which the toner that has been collected by the cleaning device 7 is carried to the developing device 4. Numeral 120 denotes the potential sensor as a potential detection means which can detect the latent image potential in an after-exposure control patch area (described later). Numeral 121 denotes the density sensor as a density detection means which can detect the after-development density of the control patch formed on the photoreceptor 1. Numeral 122 denotes the temperature sensor as a temperature detection means which can detect the temperature of the photoreceptor 1, and this temperature sensor is, for example, a thermistor provided so as to come into contact with the fringes of the photoreceptor 1.

Numeral 123 denotes the humidity sensor as a humidity detection means, and environmental conditions can be judged from the detection signal (humidity information) sent from this sensor, and the temperature information sent from the temperature sensor 122 mentioned above. It can be the from this relationship that the two sensors (122 and 123) constitute an environmental detection means.

Figure 2:
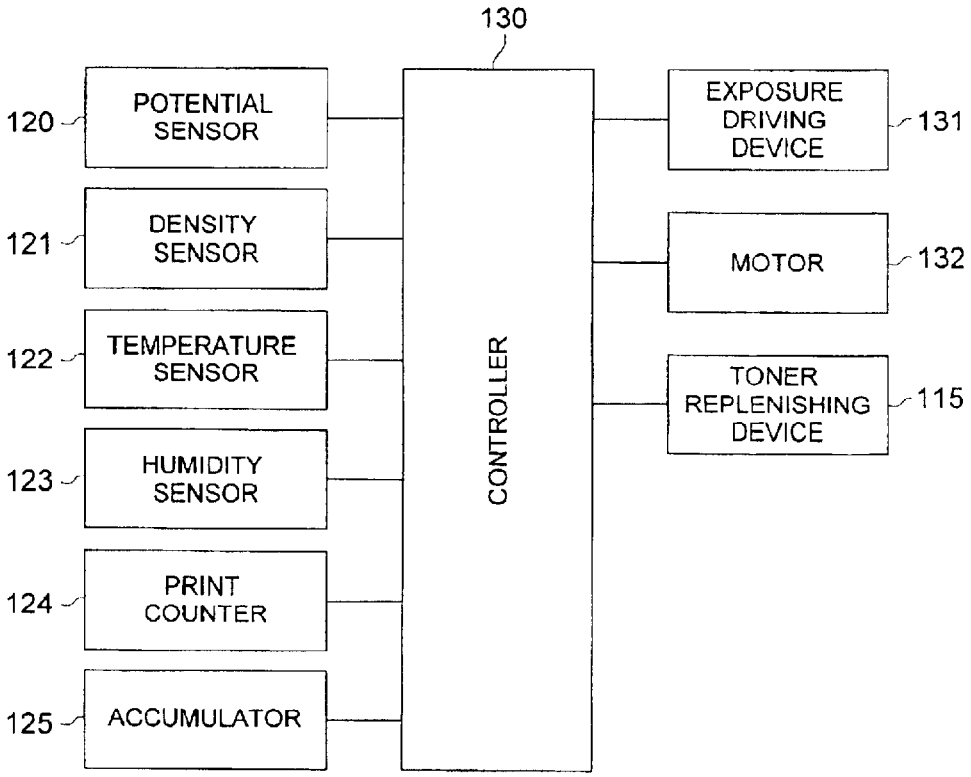
FIG. 2 is a block diagram of the control circuits in the image forming apparatus.

FIG. 2 is a block diagram of the control circuits in the image forming apparatus.

In the figures hereinafter described, the same callout numeral is assigned to the same member or means as the member or means that has already been described above, and overlapping statements are basically omitted.

In the figure, control means 130 consisting of a CPU acquires information from portions such as the aforementioned potential sensor 120, density sensor 121, temperature sensor 122, humidity sensor 123, print counter 124 for counting the number of processed sheets of recording paper P, and accumulator 125 for accumulating the stirring time of the developing agent, and performs driving and control operations on the exposure driving device 131 for driving the exposure device 3, the motor 132 for driving the developing sleeve 4A of the developing device 4, the toner replenishing device 115, and the like.

Next, the principles of the image density control used in embodiments of the present invention are described using FIGS. 3 to 6 and using the Structures of FIGS. 1 and 2 as appropriate.

Figure 3:
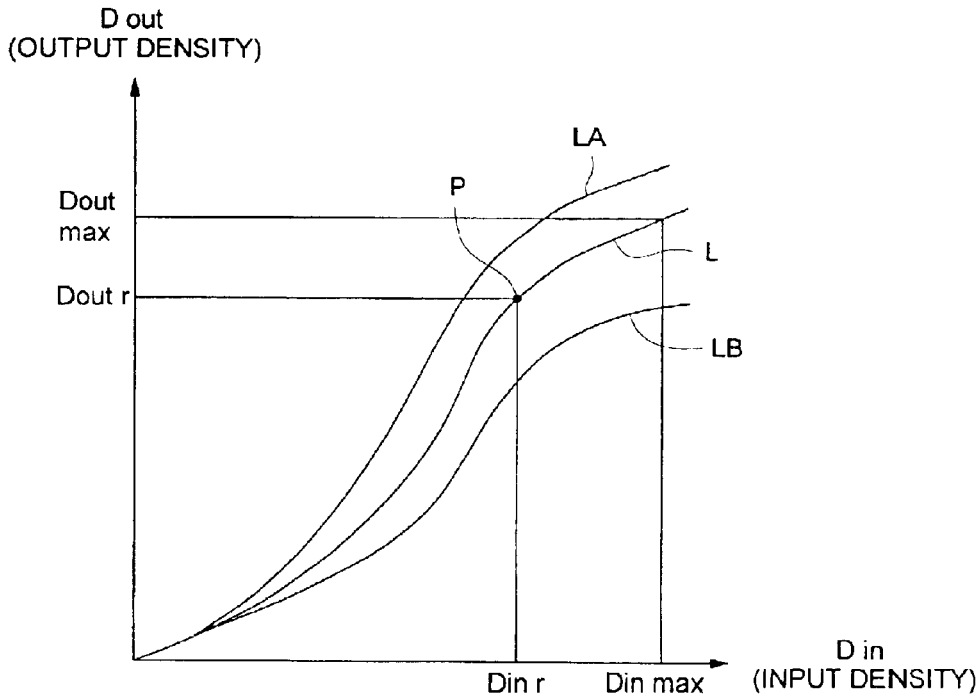
FIG. 3 is a diagram explaining the adjustment of a gradation curve that uses a control patch.
Figure 4:
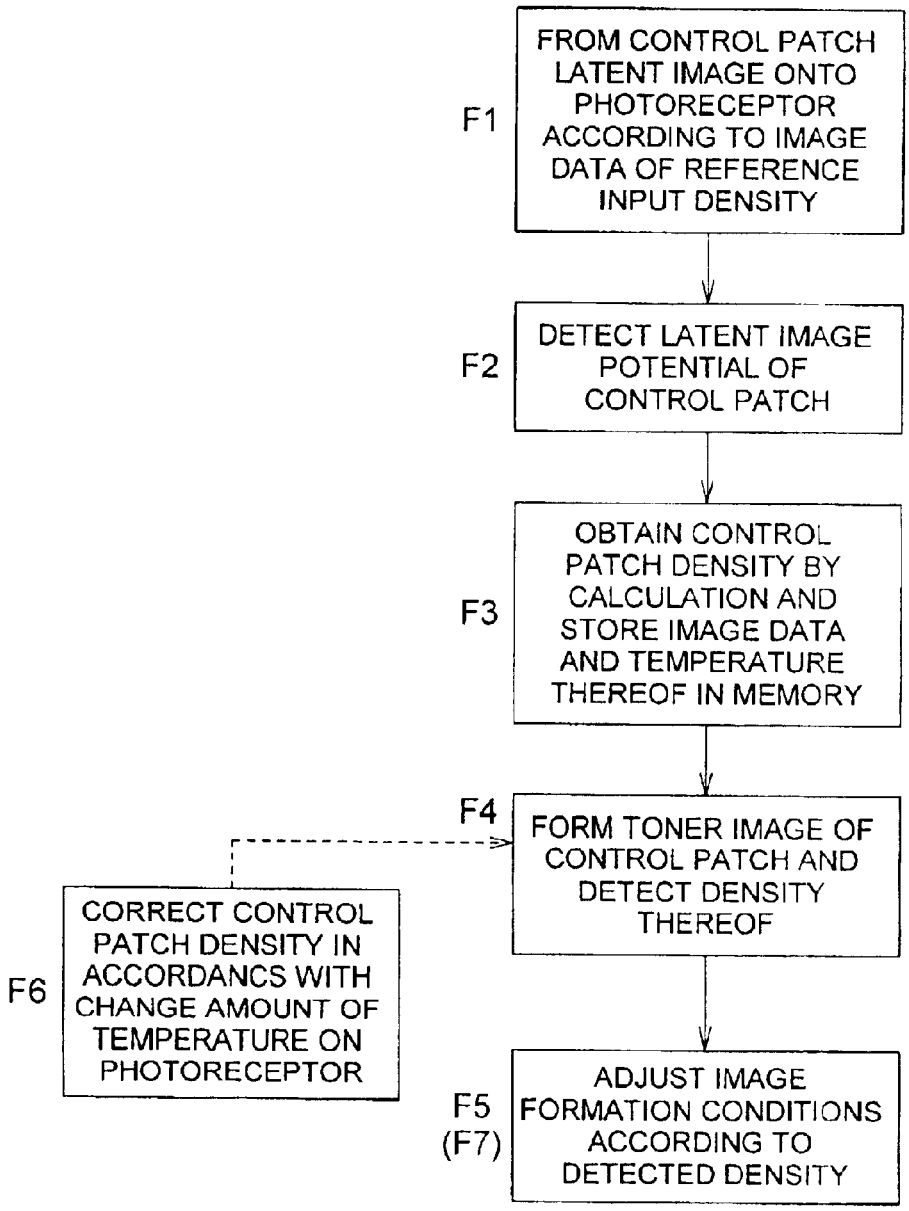
FIG. 4 is a diagram showing an image density control process.
Figure 5:
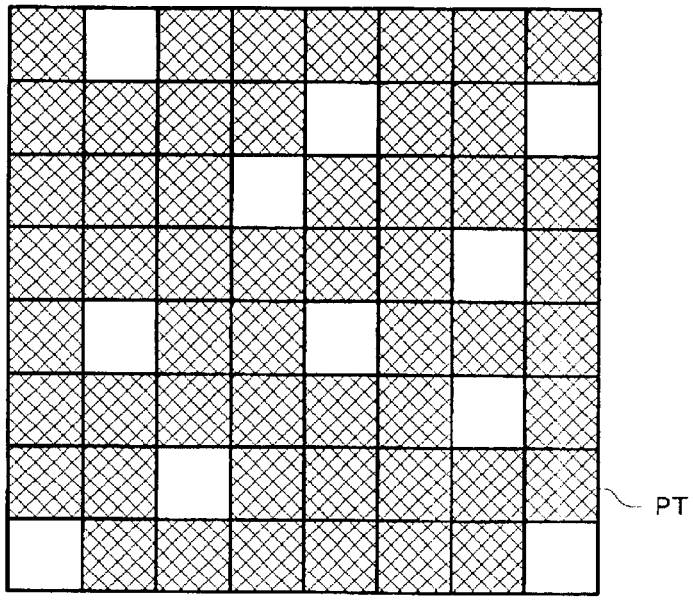
FIG. 5 is a diagram showing an example of the dither pattern constituting the control patch.
Figure 6:
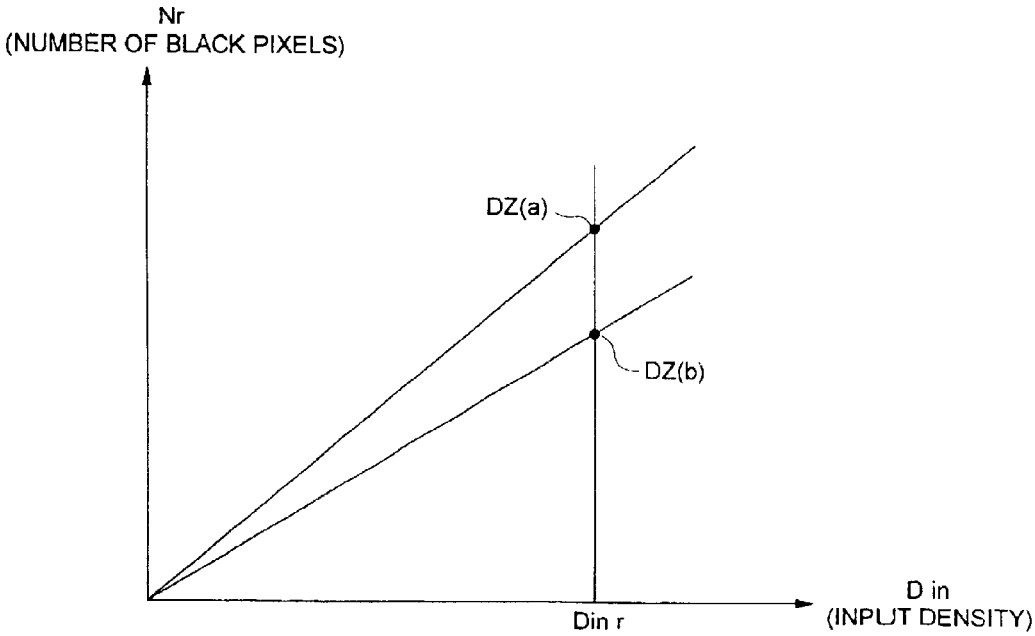
FIG. 6 is a diagram representing the relationship between input density and the number of black pixels in the dither pattern.

FIG. 3 is a diagram explaining the adjustment of grayscale level curves that uses a control patch. FIG. 4 is a diagram showing an image density control process. FIG. 5 is a diagram showing an example of the dither pattern constituting the control patch. FIG. 6 is a diagram representing the relationship between input density and the number of black pixels in the dither pattern.

In the digital image forming method used to form a latent image by dot exposure of the photoreceptor 1 by use of the optical beam (writing light) that has been emitted from the exposure light source (such as a laser) and form a visible image by developing the corresponding latent image, an image creating the desired reference grayscale level curve L represented by the maximum density, gamma-characteristics, and the like, is formed by controlling image forming conditions so that as shown in FIG. 3, the density of the image formed by development, namely, output density "$D_{out}$" has the required relationship with respect to the input density "$D_{in}$" of the image data for activating the exposure light source to emit light.

The form the above-mentioned reference grayscale level curve L varies according to the particular type of image or the particular purpose of use of the image. For example, a grayscale level curve that shows hard-tone grayscale characteristics is selected for a character image, or a grayscale level curve that shows image characteristics high in middle-tone reproducibility is selected for a photographic image.

And if the image characteristics overstep the desired characteristics curve, the image forming conditions will be controlled for image density control.

The available methods of image density control are, for example, by controlling the exposure amount and by controlling the developing conditions such as the toner concentration in the developing agent.

In FIG. 3, the horizontal axis represents input density "$D_{in}$" (namely, the density of the image data input to the exposure driving device 131; for example, 8-bit 256-level density), and the vertical axis represents output density "$D_{out}$" (namely, the image density of the toner image which was formed on photoreceptor 1.

Curve L is the desired reference grayscale level curve, and curves LA and LB are the grayscale level curves to be corrected.

During image density control, although the grayscale level curve is corrected by detecting the image density values at several points on the grayscale level curve, the entire grayscale level curve is usually corrected by, for example, detecting the output density value "$D_{outr}$" at one point P of the high-density portion of the curve and then controlling the image density at point P.

The point corresponding to input density "$D_{inr}$" which gives output density ""$D_{outr}$" slightly lower than the maximum output density "$D_{outmax}$" is selected as point P.

In this way, density slightly lower than the maximum density is selected in order to avoid the area in the vicinity of the maximum density at which any changes in output density decrease, in other words, the area in which the sensitivity of the density sensor decreases.

The available methods of image density control at point P are by controlling the exposure amount and by controlling the developing conditions.

The developing conditions can be controlled by replenishing toner and controlling the toner concentration in the developing agent, by controlling the developing bias voltage, by controlling the developing agent carrying velocity of the developing sleeve 4A, or using other methods. In the case of laser exposure, the exposure amount can be controlled by controlling the driving current, by controlling the driving pulse width, by changing the relationship of the number of black pixels with respect to image data, and using other methods.

The image density control process in the present embodiment is described below supplementing the schematic diagram of FIG. 4.

First after potential correction has been executed for adjustment of the developing bias voltage, grid voltage, and the like, a latent image of the control patch consisting of a dither pattern based on the image data of reference input density is formed on the photoreceptor 1 that has been charged to the required potential (F1).

The formation is accomplished by exposing the charged photoreceptor 1 to the writing light from the laser light source.

Also, a plurality of control patches are formed and the formation of each control patch is based on image data different in reference input density (synonymous with the number of black pixels).

In the present embodiment, the number of control patches formed is six. The latent image potential of each such control patch, in other words, the surface potential on photoreceptor 1 in the area where the latent image of each control patch has been formed is detected by potential sensor 120 (F2).

Next, the control patch density (synonymous with the number of black pixels) that determines the required latent image potential is derived by an arithmetic operating means by performing arithmetic operations on the relationship between the above-mentioned latent image potential and reference input density, and image data related to the density of the corresponding control patch is stored into a storage means. At the same time, the temperature of the photoreceptor 1 at this time is detected by temperature sensor 122 and stored into the storage means (F3).

In the present embodiment, processes up to the above are performed during the time from completion of each morning's power-on sequence for the image forming apparatus to the start of normal image formation, namely, during the initialization of the apparatus.

Next, for example, immediately before normal image formation is started (for example, immediately after an image forming command has been detected), a toner image of the control patch having the density which has been derived by arithmetic operations during F3 is formed on the photoreceptor 1 and the density of the after-development control patch is detected by density sensor 121 (F4).

And in accordance with the detection signal sent from density sensor 121 during (F4) above, the image forming conditions are adjusted/controlled so that an image of the desired density can be formed (F5).

Also, the temperature of the photoreceptor 1 during the creation of the control patch in F4 is detected by the above-mentioned temperature sensor 122, and when the temperature of the photoreceptor 1 during the creation of the control patch is changing with respect to the temperature of the photoreceptor 1 during the above-mentioned arithmetic operations and therefore requires adjustment of the corresponding control patch, the density of this control patch is changed (corrected) according to the particular change between the temperatures (F6).

In this case, the control patch having the changed density is created on the photoreceptor, then the density of the after-development patch is detected by density sensor 121, and the image forming conditions are adjusted in accordance with the resulting detection signal (F7).

Not only the above-mentioned storage means, but also all programs for purposes such as monitoring changes in the temperature of the photoreceptor and changing the density of the control patch according to the particular change in the temperature of the photoreceptor, are located in control means 130, and the arithmetic operating means is one of the closed loops in the program.

As shown in FIG. 5, the pattern of the control patch in the present embodiment is composed of a dither pattern PT.

This dither pattern can be any known dither pattern based on the systematic dither method or the random dither method.

The use of a dither pattern enables a pattern having any density even in a high-density portion to be formed with high density resolution, and thus image density to be controlled with high accuracy.

An error diffusion (ED) pattern or a laser pulse width modulation (PWM) pattern can be used for the control patch pertaining to the present invention, and similarly to the case that a dither pattern is used, highly accurate image density control is possible.

FIG. 6 represents the relationship between the input density "$D_{in}$" of input image data and the number of black pixels in a dither pattern that denotes the density of the control patch.

Either the number of black pixels, DZ(a), in a control patch relatively high in density with respect to reference input density "$D_{inr}$", or the number of black pixels, DZ(b), in a control patch relatively low in density is selected and set, depending on the particular set of conditions.

The density of a control patch that is denoted as the number of black pixels DZ with respect to reference input density "$D_{inr}$", is changed as follows according to the particular set of conditions:

(1)<Environmental Parameters>

The quantity of electric charge on toner changes with environmental parameters, namely, temperature and humidity.

Therefore, image density also changes according to the particular environmental changes, and corrections for these changes are performed.

Under high temperature and high humidity, toner decreases in charge holding force and hence in the quantity of electric charge, Q/M (Q: quantity of electric charge, M:mass).

Under high temperature and high humidity, therefore, image density tends to increase, and fogging, toner scattering, and other unfavorable events become prone to occur.

The number of black pixels in the dither pattern constituting the control patch is changed with respect to reference input density as a method of correction for the above events.

For example, the environmental conditions are classified as appropriate (the classification is described later), and corrections are performed so that, for example, as the ambient temperature and humidity (environmental conditions) increase, the number of black pixels will also increase.

These corrections are performed by control means 130, subject to the detection signals sent from temperature sensor 122 and humidity sensor 123.

An image almost free from changes in density due to environmental changes can be formed by such corrections.

(2)<Amount of Image Formation>

As the developing agent is consumed, the electrical charging capability of the carrier and the quantity of electric charge on the toner will decrease.

Accordingly, as the amount of image formation increases; more specifically, the number of prints increases, there will occur a greater discrepancy between the density of the control patch and the density of an actual image.

As the amount of image formation increases, fogging and toner scattering will also be more prone to occur.

The adjustment operation required against these events is, for example, to reduce the density of the control patch according to the particular increase in the amount of image formation.

Such correction is made by control means 130 in accordance with the number of prints that has been counted by print counter 123 as the amount of image formation. The table representing the relationship between the amount of image formation and the number of black pixels in the control patch is stored within the memory of control means 130.

Print counter 123 counts the cumulative number of prints and is initialized when the developing agent in developing device 4 is replaced.

(3)<Stirring Time of the Developing Agent>

Fatigue of the developing agent is caused by the progress of the stirring thereof. Therefore, the fatigue level can be accurately measured by measuring the amount of stirring of the developing agent, instead of the amount of image formation.

More specifically, the fatigue level can be detected by, for example, detecting the cumulative amount of rotation of the stirring screws 4B constituting the developing agent stirring means in developing device 4.

In accordance with the detection signal from the developing time accumulator 124 which counts the cumulative amount of rotation of the stirring screws, control means 130 corrects the number of black pixels in the control patch.

The relationship between the above-mentioned cumulative value and the number of black pixels in the control patch is stored within the memory of control means 130, and the cumulative count of the accumulator 124 is initialized when the developing agent in developing device 4 is replaced.

FIG. 7 is a correction diagram representing the relationship between the temperature difference and the amount of change (the amount of correction), established when the density of the control patch consisting of a dither pattern is changed (corrected).

In the figure, T1 denotes the Celsius temperature (° C.) of the photoreceptor existing during arithmetic operations by which the density of the control patch for creating the desired latent image potential is derived from the relationship between the latent image potential and density of the control patch having a plurality of reference input densities, and T2 denotes the Celsius temperature (° C.) of the photoreceptor existing during the preparation of the control patch whose density has been derived by the above arithmetic operations.

Hereinafter, the Celsius temperature is referred to simply as the temperature or degrees, or as the case may be, briefly termed as appropriate.

The temporal elements "during arithmetic operations" or "during the preparation of the control patch" in the above explanatory statement do not refer to strict points of time; they include a temporal range in which no trouble is caused to control.

The new control patch density value to be obtained by changing the arithmetically derived value according to the particular change in the temperature of the photoreceptor can be calculated as follows:

More specifically, if the density value of the control patch that has been derived by the foregoing arithmetic operations (namely, the number of black pixels) is taken as P1 and the new density value required of the control patch (namely, the new number of black pixels required) is taken as P2 (these phases can be understood from the description of FIG. 4), the new density value required can be calculated using the expression "P2=P1+(that change in the number of black pixels which corresponds to T2−T1)".

For example, if the temperature T2 of the photoreceptor increases by eight degrees with respect to temperature T1 (that is to say, in FIG. 7, "8" in the vertical line of the "T2−T1" column which denotes a temperature difference applies) and the environment is of normal temperature and normal humidity, "−1" in the vertical cell of "NN" that corresponds to "8" in the vertical line of "T2−T1" denotes the amount of change in the density of the control patch (synonymous with the density value thereof).

In other words, if P1 is the density value of the control patch with "110" black pixels, the number of black pixels at P2 is changed to "109" and the density value of the control patch is correspondingly changed.

Conversely, if the temperature T2 of the photoreceptor is nine degrees lower than temperature T1 (that is to say, "−9" in the vertical line of the "T2−T1" column applies) and the environment is in a normal-temperature normal-humidity region, "1" in the vertical cell of "NN" that corresponds to "−9" in the vertical line of "T2−T1" denotes the amount of change in the density of the control patch. In other words, if P1 is "110", P2 is changed to "111" and the density value of the control patch is correspondingly changed.

As can be understood from the above and FIG. 7, the present invention contains considerations so that image formation with more stable image density can be achieved by changing the density of the control patch according to not only the particular change in the temperature of the photoreceptor, but also the particular environmental changes.

The classification of environmental conditions in the top line of the figure, ranging from "NN" to "HL2", corresponds to the following classification in the present embodiment: Normal-temperature high-humidity NH, normal-temperature normal-humidity NN, normal-temperature low-humidity NL, normal-temperature low humidity NL2, high-temperature high-humidity HH, high-temperature normal-humidity HN, high-temperature low-humidity HL, high-temperature low-humidity HL2, low-temperature high-humidity LH, low-temperature normal-humidity LN, low-temperature low-humidity LL (11 groups in all)

The above classification was obtained by splitting the temperature range into three areas (normal-temperature, high-temperature, and low-temperature) and then further splitting only the low-humidity region in the normal-temperature and high-temperature areas into two sub-areas combined with the respective relative humidifies, and is based on experimental results.

For example, the normal-temperature area can be achieved by splitting the range of temperatures of 15° C. or more, but less than 25° C., and relative humidifies of 15% or more, but less than 65%, into four segments. Similarly, it is possible to achieve the high-temperature area by splitting the range of temperatures of 25° C. or more and relative humidifies of 65% or more, into four segments, and the low-temperature area by splitting the range of temperatures less than 15° C. and relative humidifies less than 15% into three segments.

The above-described correction diagram is stored within the storage means of the control means. Images almost free from changes in density with respect to changes in the temperature of the image forming medium or changes in the environment, can be formed by controlling the required image forming conditions in accordance with the density detection signal of a control patch based on such correction as described above.

The above-described image density control pertaining to the present invention is particularly valid for the image formation that uses polymerized toner.

Polymerized toner is toner manufactured using the method described below, and has the characteristics that because it is small in particle size and because it has a sharp particle size distribution, the toner offers high resolution and excellent tone reproducibility. The application of the present invention to the image forming process that uses polymerized toner enables these characteristics to be fully utilized and images to be formed with stable density and with almost no occurrence of events such as fogging.

<Method of manufacturing polymerized toner>: Polymerized toner means the toner obtained by creating toner-use binder resin, polymerizing the raw monomer or pre-monomer of the binder resin into toner shape, and subsequent chemical processing. More specifically, polymerized toner means the toner obtained by polymerization such as suspension polymerization or emulsion polymerization, and the fusion of particles that is subsequently conducted as required.

Since polymerized toner is manufactured by polymerizing the raw monomer or pre-monomer after these monomers have been uniformly dispersed in a water-containing substance, toner uniform in particle size distribution and in shape can be obtained.

It is desirable that the toner used in the present embodiment should be toner having a small mass mean particle size from 3 to 8 $\mu$m.

The mass mean particle size is a mass-based mean particle size, which is a value measured by the "Coulter Counter TA-II" or "Coulter Multisizer", both having a wet-type dispersion machine and manufactured by Beckman Coulter, Inc.

Next, the control conducted by the above-mentioned control means 130 is described in detail. The basic control conducted by control means 130 refers to image density control described above, that is to say, matching the grayscale level curves LA and LB in FIG. 3 to the reference grayscale level curve L therein; more particularly, matching "$D_{outmax}$" to "$D_{inmax}$."

Such image density control encompasses the control that changes the rotational speed of the developing sleeve 4A, and the control that conducts toner replenishment.

Also, such image density control can be divided into image density control A and image density control B. Image density control A is executed as various forms such as adjustment of the developing agent carrying velocity, adjustment of the developing bias, and adjustment of the exposure amount, and this type of control is executed before or after the image forming process, in order to provide correction primarily for any changes in developability due to changes in the quantity of electric charge on the toner.

In the present embodiment, image density control A is implemented by adjusting the developing agent carrying velocity, one of the image forming conditions.

In the present embodiment, adjustment of the developing agent carrying velocity is accomplished by adjusting the ratio of the moving velocity of the photoreceptor with respect to that of the developing sleeve, that is to say, "Vs" (moving velocity of the developing sleeve)/"Vp" (moving velocity of the photoreceptor).

Hereinafter, the above-mentioned ratio "Vs/Vp" is referred to as the developing sleeve–photoreceptor velocity ratio.

When the static status of the developing agent is maintained for a long time with the toner free from frictional charging, the quantity of electric charge on the toner will decrease.

As a result, even when the toner concentration in the developing agent does not change, there will be a tendency for too dense an image to be formed during the startup of the image forming apparatus or after its extended stand-by status. Image density control A, therefore, provides correction primarily for these changes in developability.

During image density control A, as outlined earlier using FIG. 4, the-control patch consisting of a dither pattern is formed on photoreceptor 1, then the image density of this control patch is detected by density sensor 121, and the rotational speed of the developing sleeve 4A, in other words, the developing sleeve–photoreceptor velocity ratio is set as one of the image forming conditions, subject to density detection results.

The developing sleeve–photoreceptor velocity ratio of the developing sleeve 4A can be set to any of, for example, 32 levels, and the relationship of the developing sleeve–photoreceptor velocity ratio with respect to the image density of the control patch is stored within the memory of the control means 130.

Not only during power-on of the image forming apparatus, but also during the start of image formation from a power saving mode, image density control A can be executed prior to the start of image formation from a stand-by status.

Image density control A can also be executed at fixed time intervals throughout a stand-by status and the execution of the image forming process.

Image density control B is control executed during the image forming process, and correction for decreases in toner concentration, associated with toner consumption, correction for changes in the developing performance of the developing agent, and other corrections are conducted by image density control B.

In the examples described below, although, during image density control B, image density adjustment is accomplished by conducting toner replenishment control and developing sleeve–photoreceptor velocity ratio control as image forming conditions, toner replenishment can be combined with the adjustment of, for example, the developing bias or the exposure amount, instead of the adjustment of the developing sleeve–photoreceptor velocity ratio.

Figure 8:
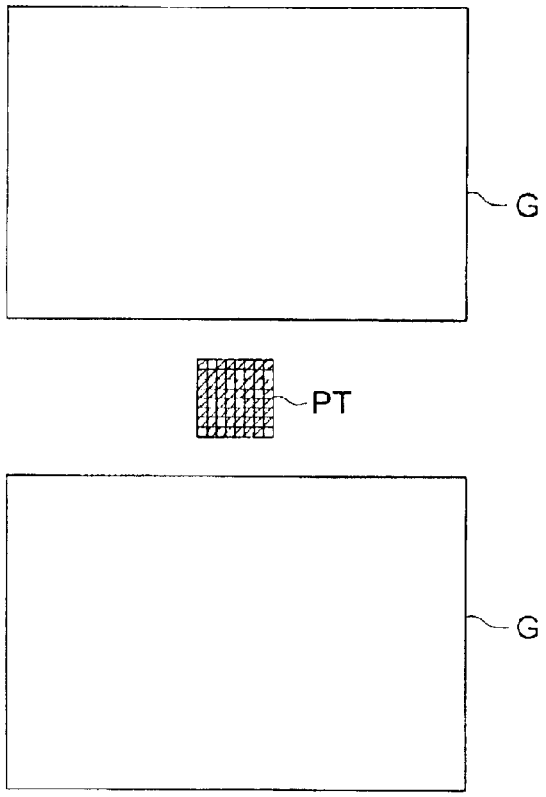
FIG. 8 is a view showing the position of the control patch.

As described above, image density control B is control executed during the image forming process, and during the control, a control patch PT is formed between two image areas G, as can be understood from FIG. 8 showing the position of the control patch, then the image density of the formed control patch PT is detected, and the image forming conditions are controlled in accordance with density detection results (the image density control process is basically the same as in FIG. 4).

Such image density control is executed each time a plurality of, for example, five image prints are created.

Figure 9:
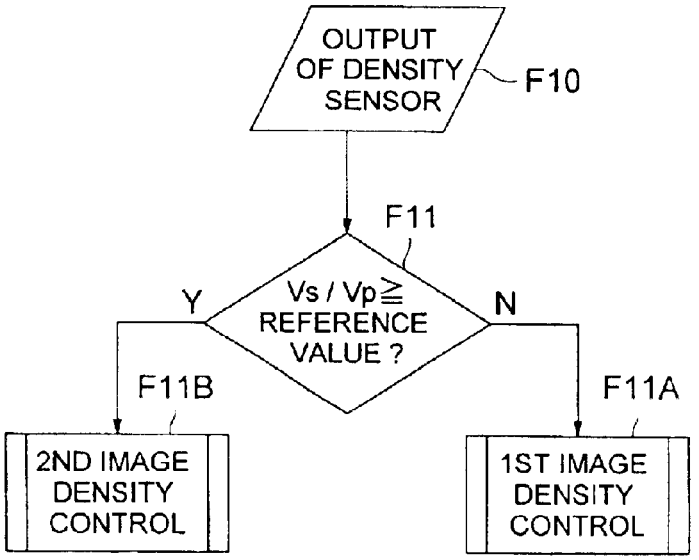
FIG. 9 is a flowchart of image density control B.
Figure 10:
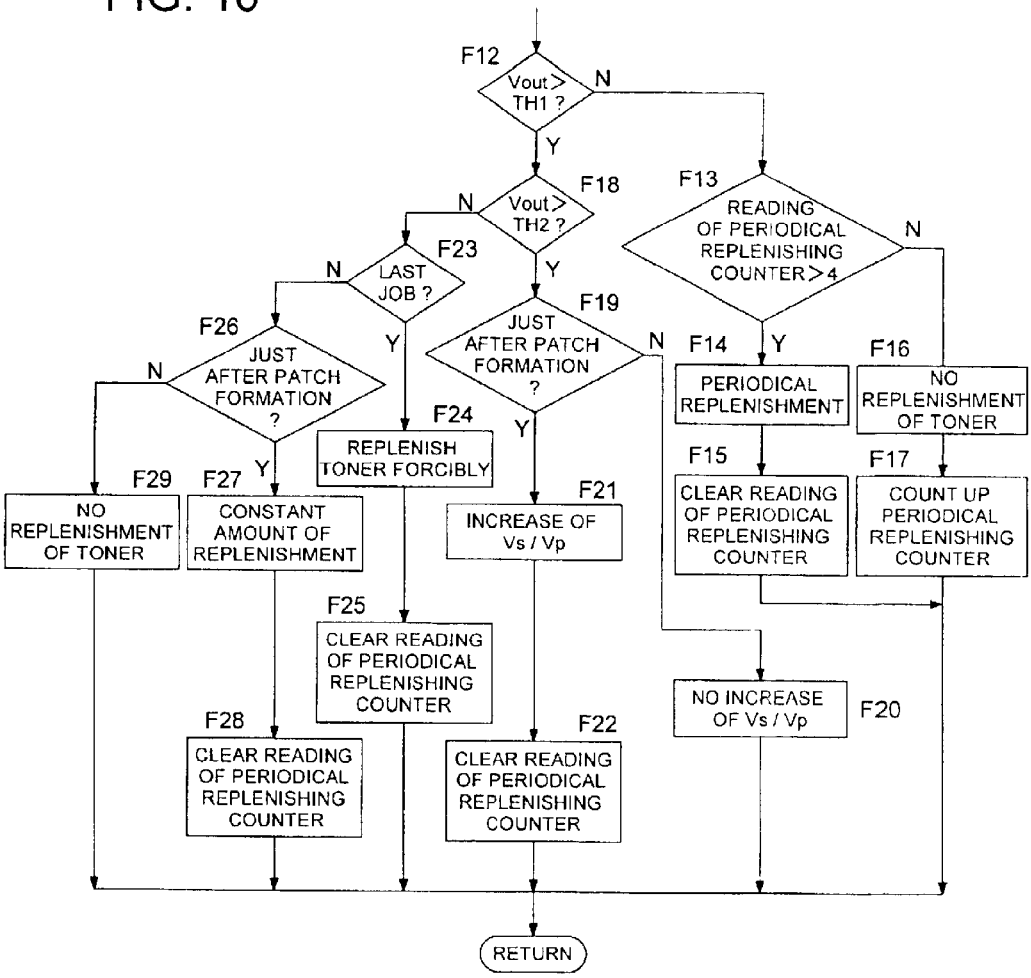
FIG. 10 is a flowchart of image density control B.
Figure 11:
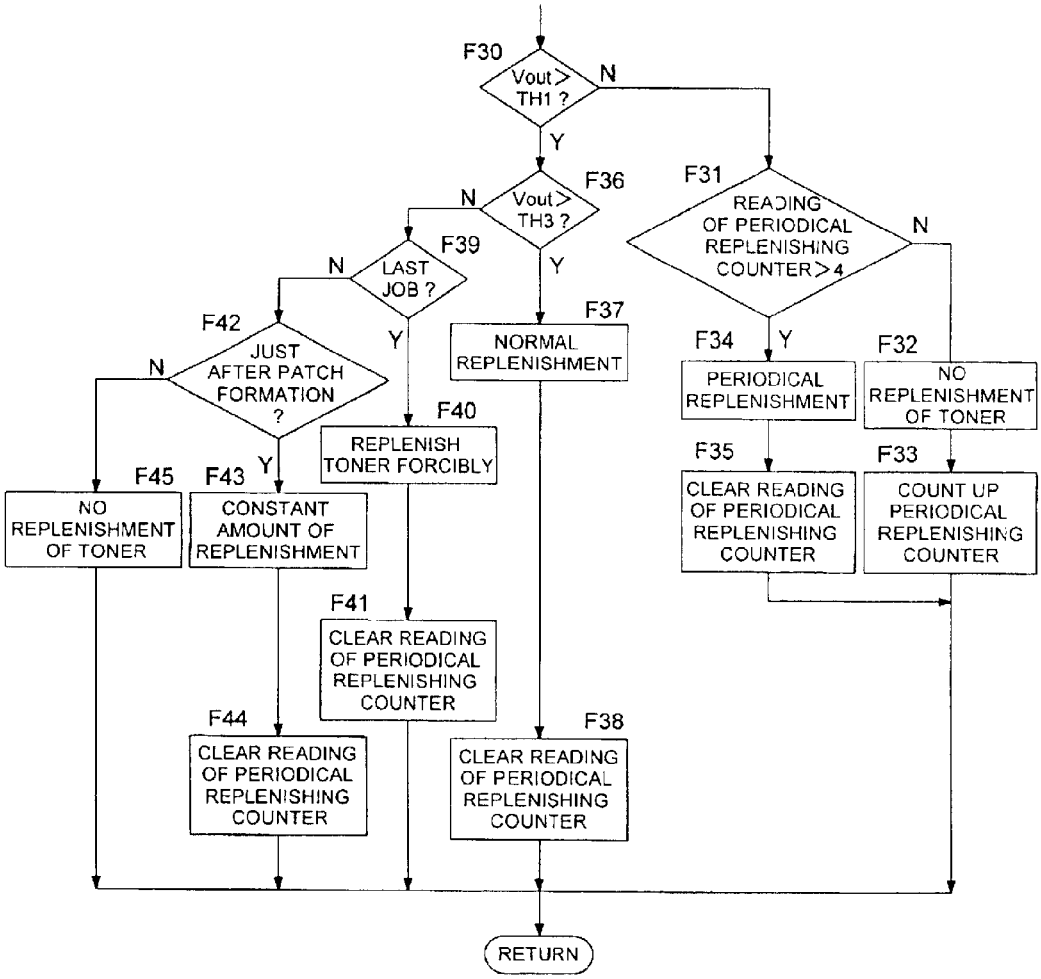
FIG. 11 is a flowchart of image density control B.

FIGS. 9, 10, and 11 are flowcharts of image density control B.

The first to third threshold values (TH1 to TH3) in FIGS. 10 and 11 discriminate "$V_{out}$", the output of the density sensor 21, and are maintained in the relationship of (The first threshold value TH1<The second threshold value TH2<The third threshold value TH3).

Since image density and the output "$V_{out}$" of the density sensor 121 are maintained in the relationship that the output decreases with increases in image density, there is established the relationship of (Image density of the first threshold value TH1>Image density of the second threshold value TH2>Image density of the third threshold value TH3).

The value of the second threshold value TH2 constantly changes according to the particular status of the developing device and may therefore be reversed in terms of magnitude with respect to the first threshold value TH1 and the third threshold value TH3.

The image density of the control patch in image density control B (hereinafter, this image density is referred to as the patch density) is detected by density sensor 121, as in image density control A.

Under image density control B, as shown in FIG. 9, during the judgment at F11 that follows the reading of the output of the density sensor 121 at F10, if the reference value of the developing speed–photoreceptor velocity ratio "$V_s/V_p$" is not reached, first image density control F11A will be executed or if the reference value of the developing speed–photoreceptor velocity ratio "$V_s/V_p$" is reached, second image density control F11B will be executed.

In first image density control F11A, control is provided so as to increase image density by increasing the developing speed–photoreceptor velocity ratio "$V_s/V_p$", and in second image density control F11B, control is provided so as to increase image density by replenishing toner, instead of increasing the developing speed–photoreceptor velocity ratio "$V_s/V_p$."

Figure 19:
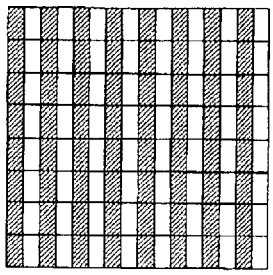
FIGS. 19(*a*) to 19(*f*) show the patches that have been formed by pulse width modulation.
Figure 19:
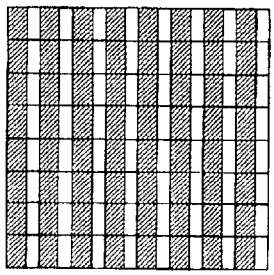
Figure 19:
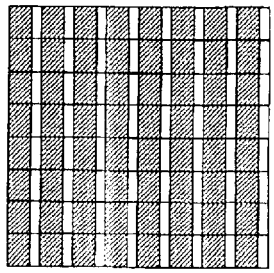
Figure 19:
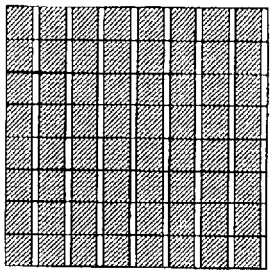
Figure 19:
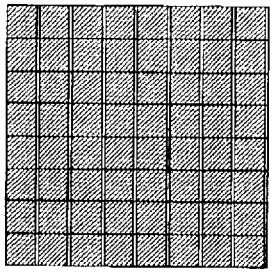
Figure 19:
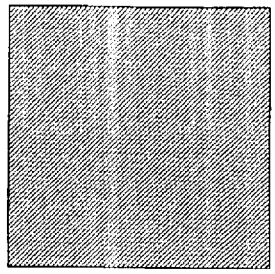

FIG. 10 shows an example of first image density control F11A, the routine of which is executed if the judgment results at F11 in FIG. 19 are N (No), in other words, if the reference value of the developing speed–photoreceptor velocity ratio "$V_s/V_p$" is not reached.

For example, if the reference value of the developing speed–photoreceptor velocity ratio "$V_s/V_p$" is not reached, whether the output "$V_{out}$" of the density sensor is greater than the first threshold value TH1 will be judged.

If the output "$V_{out}$" is smaller than the first threshold value TH1, whether the count of the periodical replenishing counter is in excess of 4 will be judged at F13.

The periodical replenishing counter is provided in control means 130, and it is a periodical replenishment control counter for executing toner replenishment each time the required quantity of image formation occurs.

In the present embodiment, periodical replenishment control is provided for periodical replenishment to be conducted each time the formation of a control patch is repeated five times.

In the case that the formation of a control patch is repeated each time five images are formed, periodical replenishment is repeated each time 25 images are formed.

If the count of the periodical replenishing counter is not in excess of 4 (in other words, if N at F13), toner replenishment will not occur (F16) and instead the count of the periodical replenishing counter will be incremented by 1 (F17).

If the count of the periodical replenishing counter is in excess of 4 (in other words, if Y at F13), periodical replenishment will occur to add the required amount of toner (F14) and then the count of the periodical replenishing counter will be cleared to zero to complete processing (F15).

If, at F12, output "$V_{out}$" is greater than the first threshold value TH1, whether the corresponding output "$V_{out}$" is greater than the second threshold value TH2 will be judged (F18).

If output "$V_{out}$" is greater than the second threshold value TH2 (in other words, if Y at F18), whether the judgment has been performed immediately after the formation of the control patch will be judged (F19).

If the judgment has not been performed immediately after the formation of the control patch, processing will be terminated without the developing sleeve–photoreceptor velocity ratio "$V_s/V_p$" being increased (F20). If the judgment has not been performed immediately after the formation of the control patch, the developing sleeve–photoreceptor velocity ratio "$V_s/V_p$" will be increased (F21) and then the periodical replenishing counter will be cleared to zero to complete processing (F22).

If, at F18, output "$V_{out}$" is smaller than the second threshold value TH2, control will be transferred to F23 and whether the job is the last in image formation will be judged.

If the job is the last in image formation (in other words, if Y at F23), forced replenishment will occur (F24) and then the periodical replenishing counter will be cleared to zero to complete processing (F25).

Forced replenishment is toner replenishment executed to adjust any changes in image density due to the difference in the quantity of image formation per job, and the required amount of toner is added in one replenishment operation.

Such forced replenishment prevents image density from decreasing in the case that, for example, the job for forming one image is continuously performed.

If, at F23, the job is judged not to be the last in image formation, control will be transferred to F26 and whether the job has been performed immediately after the formation of the control patch will be judged. If the job has been performed immediately after the formation of the control patch (in other words, if Y at F26), a constant amount of replenishment will occur (F27) and then the periodical replenishing counter will be cleared to zero to complete processing (F28). Conversely, if the job has not been performed immediately after the formation of the control patch (in other words, if N at F26), processing will be terminated without toner replenishment being occurring (F29).

A constant amount of replenishment is executed to adjust any changes in image density, associated with formation control of the control patch.

If, at F11 of FIG. 9, developing sleeve–photoreceptor velocity ratio "$V_s/V_p$" is greater than its reference value, control will be transferred to second image density control F11B.

An example of second image density control F11B is shown in FIG. 11.

For example, control will be transferred from F11 of FIG. 9 to F30 of FIG. 11 and whether the output "$V_{out}$" is greater than the first threshold value TH1 will be judged.

If the output "$V_{out}$" is smaller than the first threshold value TH1 (that is to say, if N at F30), whether the count of the periodical replenishing counter is in excess of 4 will be judged at F31.

If the count of the periodical replenishing counter is not in excess of 4 (in other words, if N at F31), toner replenishment will not occur (F32) and instead the count of the periodical replenishing counter will be incremented by 1 (F33).

If the count of the periodical replenishing counter is in excess of 4 (in other words, if Y at F31), periodical replenishment will occur to add the required amount of toner (F34) and then the count of the periodical replenishing counter will be cleared to zero to complete processing (F35).

If, at F30, output "$V_{out}$" is greater than the first threshold value TH1, control will be transferred to F36 and whether output "$V_{out}$" is greater than the third threshold value TH3 will be judged.

If, at F36, output "$V_{out}$" is greater than the third threshold value TH1, normal replenishment will occur (F37) and then the periodical replenishing counter will be cleared to zero to complete processing (F38).

Control is provided so that when a decrease in toner concentration, associated with toner consumption, reduces image density, in other words, when output "$V_{out}$" exceeds the third threshold value, normal replenishment will occur to add a constant amount of toner.

If, at F36, output "$V_{out}$" is smaller than the third threshold value TH3, control will be transferred to F39 and whether the job is the last in image formation will be judged. If the job is judged to be the last in image formation (that is to say, if Y at F39), forced replenishment will occur (F40) and then the periodical replenishing counter will be cleared to zero to complete processing (F41).

If, at F39, the job is judged not to be the last in image formation, control will be transferred to F42 and whether the job has been performed immediately after the formation of the control patch will be judged.

If the job has been performed immediately after the formation of the control patch (in other words, if Y at F42), a constant amount of replenishment will occur (F43) and then the periodical replenishing counter will be cleared to zero to complete processing (F44).

Conversely, if the job has not been performed immediately after the formation of the control patch (in other words, if N at F42), a constant amount of replenishment will occur (F43) and then the periodical replenishing counter will be cleared to zero to complete processing (F44).

<Density Adjustment of the Control Patch>

Figure 12:
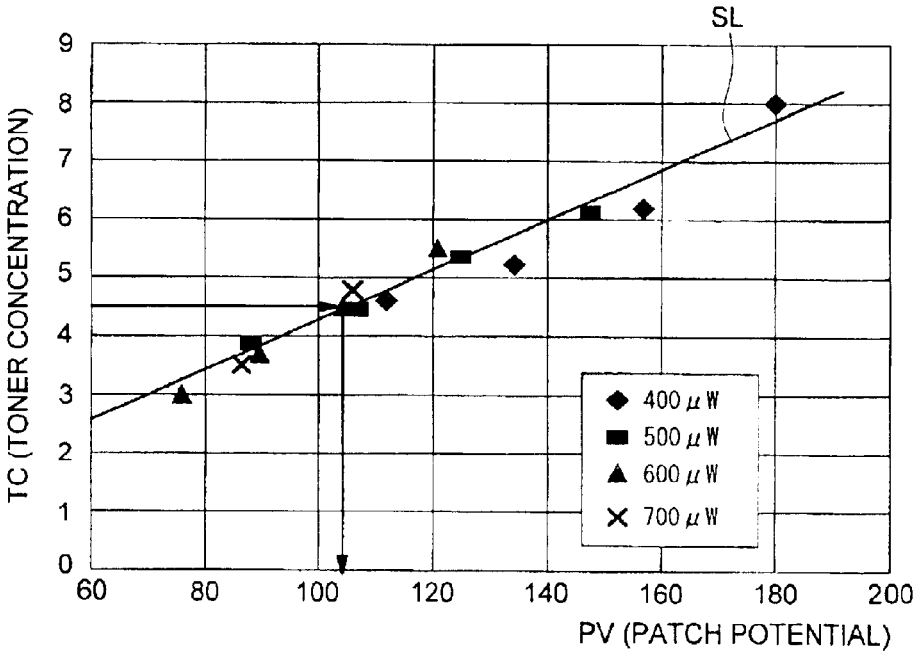
FIG. 12 is a diagram showing the relationship between the patch potential and the toner concentration.

FIG. 12 shows the relationship between the absolute value of the potential on the photoreceptor on which an electrostatic latent image of the control patch has been formed (hereinafter, the potential on the photoreceptor and the absolute value of the potential are referred to as the patch potential and PV, respectively), and the toner concentration TC in the developing agent used to form a toner image of a fixed image density from various patch potential PV values. As shown in the figure, the relationship between patch potential PV and toner concentration TC can be represented using a straight line SL. The straight line SL can be obtained by changing the driving current of the laser light source of the exposure device to various values and measuring the respective patch potential PV values. As shown in the figure, when the driving current of the laser light source is changed to various values, patch potential PV also changes linearly along the straight line SL. It can be seen, therefore, that even when the amount of light emitted from the laser light source changes, a toner image constant in image density can be formed by providing control so that the toner concentration TC is so linked as to maintain a fixed relationship with respect to the particular change in the amount of light. The patch potential PV is detected by potential sensor 120.

In the present embodiment, based on such relationship between patch potential PV and toner concentration TC as shown in FIG. 12, the number of black pixels, BX, in the dither pattern constituting the control patch is controlled according to the particular change in the amount of laser light so that a constant patch potential is always maintained.

Figure 13:
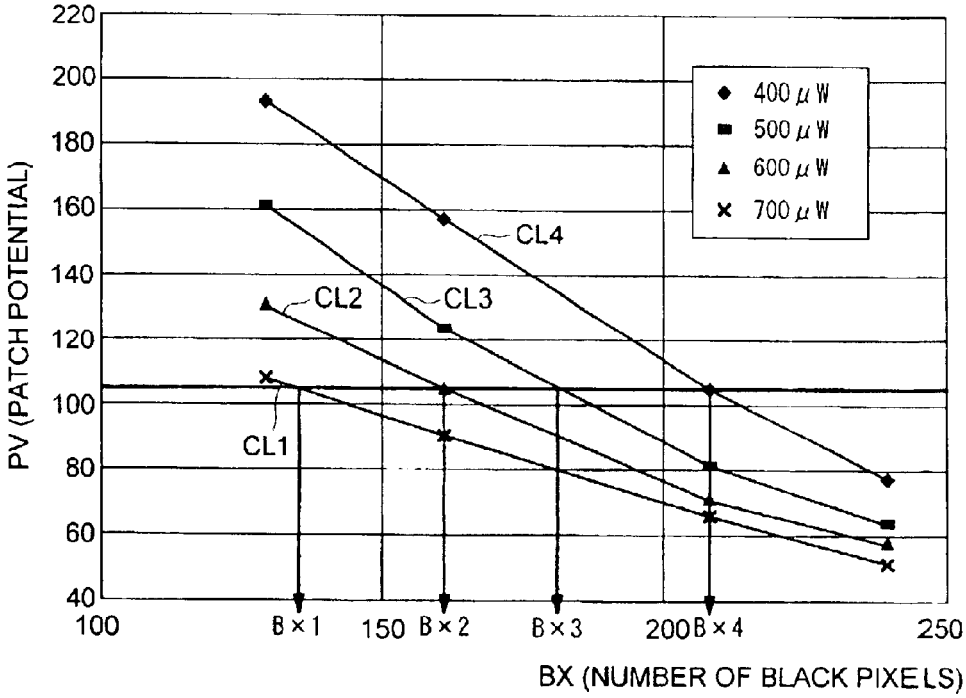
FIG. 13 is a diagram showing the relationship between the number of black pixels in the dither pattern, the patch potential, and the driving current of the laser light source.

FIG. 13 shows the relationship between the number of black pixels, BX, in the dither pattern, patch potential PV, and the driving current of the laser light source. Based on the relationship of FIG. 13, the formation of a control patch having a constant patch potential PV value is possible, even when the amount of light emitted from the laser light source changes.

That is to say, since the driving current and the number of black pixels, BX, in the dither pattern change as shown by curves CL1 to CL4, if the light-emitting characteristics of the laser light source during BX setting for the control patch are known, it is possible at that time to set BX, the number of black pixels for creating the required patch potential (in-the figure, about 105 V). In the present embodiment, therefore, where in the range of, for example, curves CL1–CL4 the characteristics shown in FIG. 13 exist is determined by changing the number of black pixels, BX, during BX setting for the control patch and then detecting the patch potentials at any two points, and after that, the number of black pixels, such as BX1 to BX4, is set.

Setting of the number of black pixels, BX, in the dither pattern, shown in FIG. 13, means correction for changes in the amount of light emitted from the laser light source, and is executed each time several ten thousand images are formed.

EXAMPLE 1

In all the comparative samples and embodiments that are described below, tests have been conducted using a copying machine created by modifying the digital copying machine "Konica Sitios 7075" manufactured by the Konica Corporation.

(1) Comparative Sample 1:

Ratio of Developing sleeve velocity to photoreceptor "$V_s/V_p$":
2.0 (set as a fixed value);
Photoreceptor: OPC (diameter: 100 mm);
Photoreceptor surface velocity: 400 mm/sec;
Developing agent: Two-component developing agent consisting of the polymerized toner having a mean particle size of 6 $\mu$m, and a carrier having a mean particle size of 60 $\mu$m;
Charging potential "$V_s$": −750 V;
Developing bias $V_{bias}$": −600 V; and
Patch bias (Control patch developing bias potential, hereinafter, the same) "$PV_{bias}$": −400 V.

50 k (50,000) copies have been created under each of three types of environments (HH, NN, and LL).

(2) Comparative Sample 2:

Ratio of Developing sleeve velocity to Photoreceptor velocity
"$V_s/V_p$": 2.0 (set as a fixed value);
Photoreceptor: OPC (diameter: 100 mm);
Photoreceptor surface velocity: 400 mm/sec;
Developing agent: Two-component developing agent consisting of the polymerized toner having a mean particle size of 6 $\mu$m, and a carrier having a mean particle size of 60 $\mu$m;
Charging potential "$V_s$": −750 V; and
Developing bias "$V_{bias}$": −600 V.

A control patch has been formed as follows:

The PWM value of the laser for obtaining the maximum density by exposure of an electrically charged photoreceptor during image formation has been set to 200 as a control patch forming value with respect to 255 as an all-LD-on value, and then the same charging and developing operations as performed for image formation have been conducted to form a toner image.

50 K (50,000) copies have been created under each of three types of environments (HH, NN, and LL).

(3) Inventive Sample 1:

Ratio of Developing sleeve velocity to Photoreceptor velocity
"$V_s/V_p$": 2.0 (set as a fixed value);
Photoreceptor: OPC (diameter: 100 mm);
Photoreceptor surface velocity: 400 mm/sec;
Developing agent: Two-component developing agent consisting of the polymerized toner having a mean particle size of 6 μm, and a carrier having a mean particle size of 60 μm;
Charging potential "$V_s$": −750 V; and
Developing bias "$V_{bias}$": −600 V.

Exposure conditions for the control patch consisting of a dither pattern: Exposure has been made with BX (the number of black pixels in the control patch) being set to 210 with respect to a BX range from 0 to 255.

50 K (50,000) copies have been created under each of three types of environments (HH, NN, and LL).

In comparative samples 1, 2, and inventive sample 1 above:

In the case of comparative sample 3, although image density has stably changed, fogging has occurred at the front end of the image since the response of the potential during changeover of the developing bias from patch bias "$PV_{bias}$" to developing bias "$V_{bias}$" was too slow.

In the case of comparative sample 2, although, immediately after power-on, normal images have been obtained, grayscale level curves have changed to reduce patch density with increases in the number of images formed. Patch density enhancement correction by image density control has increased the toner concentration, resulting in image density being too high. In addition to the deterioration of image quality, toner consumption has increased, which has resulted in greater toner consumption than necessary.

In the case of inventive sample 1, all images from the image obtained immediately after power-on under each environment, to the end of 50 k of copy printing, have been normal and stable.

(4) Inventive Sample 2:

Ratio of Developing sleeve velocity to Photoreceptor velocity
"$V_s/V_p$": Variable (reference values have been set);
Photoreceptor surface velocity: 400 mm/sec;
Photoreceptor: OPC (diameter: 100 mm);
Developing agent: Two-component developing agent consisting of the polymerized toner having a mean particle size of 6 μm, and a carrier having a mean particle size of 60 μm;
Charging potential "$V_s$": −750 V; and
Developing bias "$V_{bias}$": −600 V.

Exposure conditions for the control patch consisting of a dither pattern: Exposure has been made with BX (the number of black pixels in the control patch) being set to 210 with respect to a BX range from 0 to 255.

The image density of the control patch has been detected and image density control A for setting the developing agent carrying body–image forming medium velocity ratio "$V_s/V_p$" in accordance with detection results has been executed. Also, image density control B shown in FIGS. 9, 10, and 11 has been executed during the image forming process. The reference values of the developing agent carrying body–image forming medium velocity ratio "$V_s/V_p$" during image density control B are listed below.

HH environment: Developing agent carrying body–image forming medium velocity ratio "$V_s/V_p$"=1.9;
NN environment: Developing agent carrying body–image forming medium velocity ratio "$V_s/V_p$"=2.0; and
LL environment: Developing agent carrying body–image forming medium velocity ratio "$V_s/V_p$"=2.1.

50 K (50,000) copies have been created under the HH, NN, and LL environments each.

All images from the first image obtained immediately after power-on to the last image have been have been normal.

(5) Inventive Sample 3

The reference values shown below have been set for each environment with the ratio of the developing sleeve velocity to photoreceptor velocity "$V_s/V_p$" taken as variable:

HH environment: 1.9;
NN environment: 2.0;
LL environment: 2.1;
Photoreceptor surface velocity: 400 mm/sec;
Developing agent: Two-component developing agent consisting of the polymerized toner having a mean particle size of 6 μm, and a carrier having a mean particle size of 60 μm;
Charging potential "$V_s$": −750 V; and
Developing bias "$V_{bias}$": −600 V.

The control patch consisting of a dither pattern has been formed under the exposure conditions shown in Table 1. "BX" in Table 1 denotes the number of black pixels in the dither pattern.

TABLE 1

| Number of images | HH environment | NN environment | LL environment |
|---|---|---|---|
| 0–50 k | 220 BX | 210 BX | 200 BX |
| 51–100 k | 215 BX | 205 BX | 195 BX |
| 101–200 k | 210 BX | 200 BX | 190 BX |
| 201–500 k | 205 BX | 195 BX | 185 BX |
| 501–1000 k | 200 BX | 190 BX | 180 BX |
| Over 1001 k | 195 BX | 185 BX | 175 BX |

In the inventive sample described above, normal and stable images have been obtained in all tests from 1 to 1,000 kilo sheets.

(6) Inventive Sample 4

Figure 14:
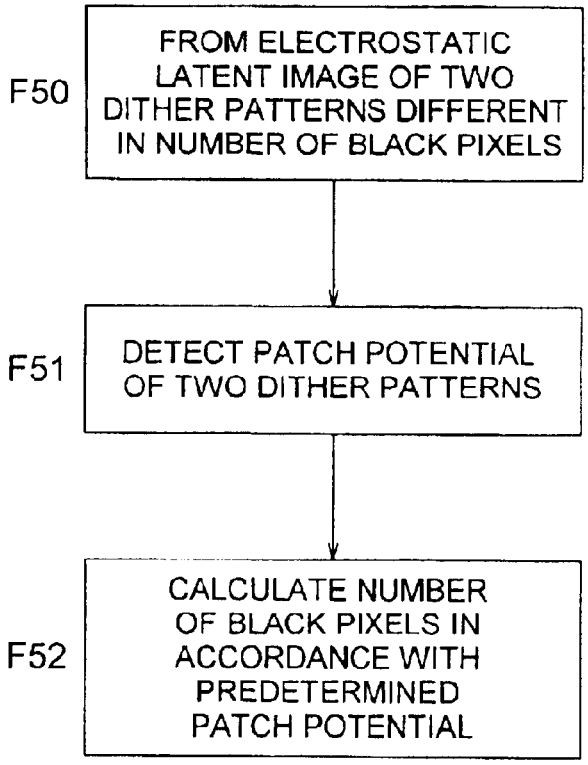
FIG. 14 is a diagram showing a process in which the number of black pixels in the dither pattern is set.

Quantitative setting of dither pattern black pixels in accordance with the flowchart of FIG. 14 has been repeated each time 5,000 images were to be formed, and images have been actually formed. As a result, images stable in density and high in image quality have been obtained in 1,000 k of image formation.

At F50 of FIG. 14, electrostatic latent images of two dither patterns different in the number of black pixels was formed on the photoreceptor. At F51, patch potentials, namely, the potentials of the formed two electrostatic latent images have been measured. At F52, such potential curves as CL1–CL4 shown in FIG. 13 have been determined from measured patch potentials, then the crossing points between each determined potential curve and the required patch potential PVR have been determined, and a different number of black pixels has been determined for each dither pattern.

The adoption of either Structure (1), (7), (12), (13), (14), (15), (16), (17), (19), (20), (21), (22), or (23) creates, even during high-speed image formation, no time delay in changeover between the image forming conditions using a control patch and the image forming conditions used for actual image formation on recording media, minimizes the unevenness in the image density of the control patch due to a time delay in the changeover of the image forming conditions, prevents the occurrence of fogging during image formation, thus enabling high-quality images to be formed in high-speed image formation. Also, images constant in image quality and not affected by changes in the developing performance of the developing agent can be formed.

The adoption of either Structure (2), (9), or (25) enables the formation of images constant in image quality and not affected by changes in the developing performance of the developing agent.

The adoption of either Structure (3) or (10) enables images constant in image quality to be formed, even in a great amount of continuous image formation, and a highly durable image forming apparatus to be realized.

The adoption of either Structure (4), (11), or (27) enables the formation of images constant in image quality and not affected by the fatigue level of the developing agent.

The adoption of either Structure (5) or (8) effectively minimizes changes in image density due to the insufficiency in the quantity of electric charge on the toner during the startup of the image forming apparatus, and makes it possible to always form images constant image quality.

The adoption of either Structure (6) or (18) enables the formation of high-quality images excellent in resolution and in tone reproduction.

The adoption of either Structure (24), (28), or (29) enables constant image density to be maintained without being affected by changes in the amount of light emitted from the exposure light source.

The adoption of structure (26) makes it possible to always form images constant image quality and free from changes in image quality according to the particular quantity of image formation.

Figure 15:
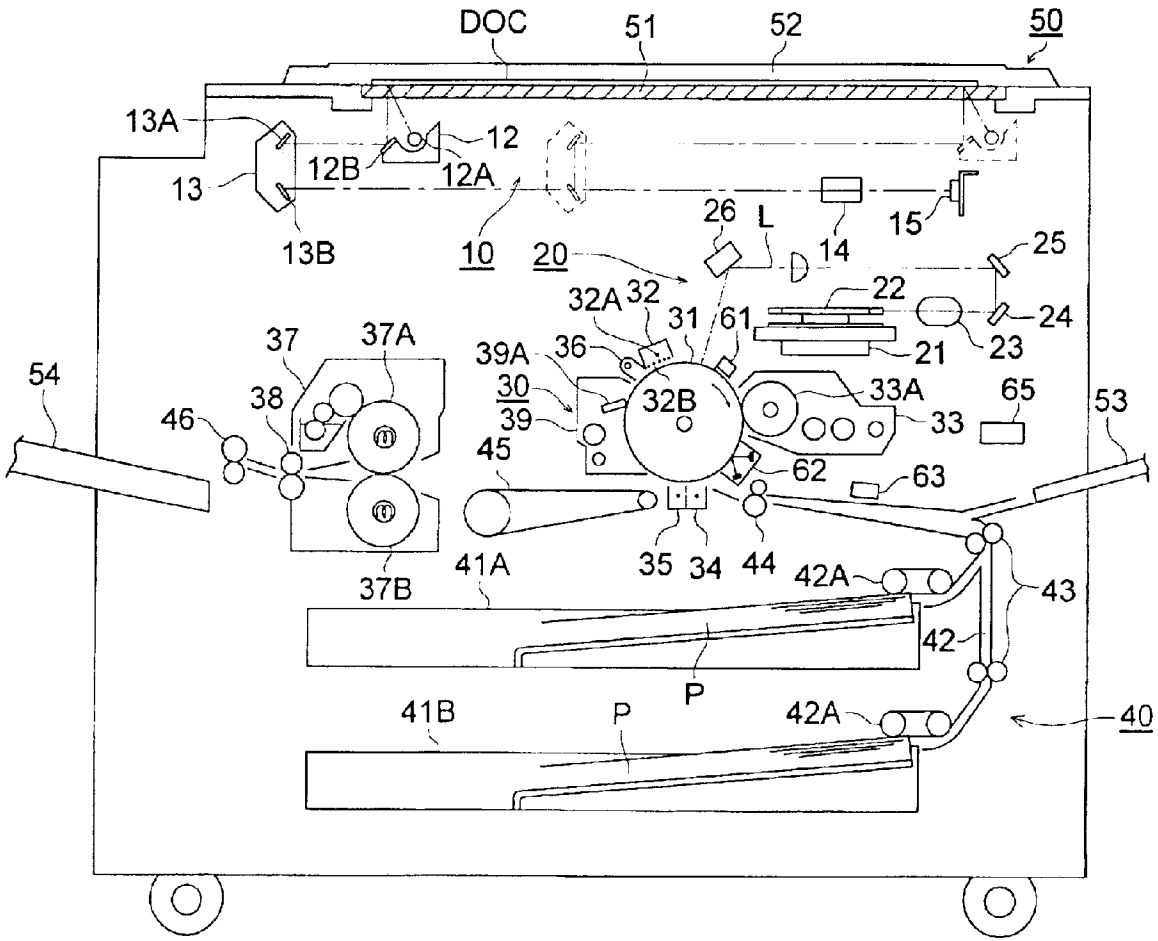
FIG. 15 shows the structure of the image forming apparatus pertaining to the present invention.

Apparatus structure common to all embodiments of the image forming apparatus pertaining to the invention, and the operation of the apparatus are described using FIG. 15. The present invention, however, is not limited by the corresponding structure.

The foregoing apparatus comprises an image reading section 10, a laser writing section 20, an image forming body 30, a paper feeding section 40, and an original document placement section 50.

At the top of the image forming apparatus is located the original document placement section 50 comprising a document setting table 51, which is further made up of a transparent glass plate and other components, and a document cover 52 for covering the original document placed on the document setting table 51. Underneath the document setting table 51, inside the main unit of the apparatus, is located the image reading section 10 comprising a first mirror unit 12, a second mirror unit 13, a main lens 14, and an image pickup element 15 such as a CCD array. The first mirror unit 12 has an illumination lamp 12A and a first mirror 12B, is installed so as to be linearly movable in parallel with the document setting table 51 and horizontally in FIG. 1, and optically scans the entire surface of the original document. The second mirror unit 13 has a second mirror 13A and a third mirror 13B in integrated form and moves linearly to both the left and the right at half the speed of the first mirror unit 12 so that the required optical path length is always maintained. Of course, the movement of the second mirror unit 13, as with that of the first mirror unit 12, is parallel to the document setting table. The image within the original document placed on the document setting table illuminated by the illumination lamp 12A is sent to the main lens 14, then further sent to the first mirror 12B, the second mirror 13A, and the third mirror 13B, where the image is then formed on the image pickup element 15. After scanning, the first mirror unit 12 and the second mirror unit 13 return to the respective original positions and stand by for the next image formation.

Image data that has been obtained by the image pickup element 15 undergoes processing by an image signal processor not shown in the figure, and is then temporarily stored into a memory as an image signal. Next, the image signal is sent to the laser writing section 20.

The image forming body 30 starts the image recording operation when, by the control of a control section, the image signal from the memory is sent to the laser writing section 20 comprising a driving motor 21, a polygonal mirror 22, an "fθ" lens 23, mirrors 24, 25, and 26, a semiconductor laser, and a correction lens (the last two elements are not shown in the figure). That is to say, a photoreceptor drum 31, the image forming body, rotates clockwise in the direction of the arrow shown in the figure, then after being electrically discharged by a discharging device 36 by conducting pre-discharging exposure, the photoreceptor drum is assigned a minus charge (in the present embodiment) by a charging device 32 equipped with a discharging wire 32A and with a charging grid 32B, and hereby, the electrostatic latent image corresponding to the image within the original document is formed on the photoreceptor drum 31 by the laser beam L irradiated from the laser writing section 20. After this, the above-mentioned electrostatic latent image on the photoreceptor drum 31 undergoes reversal development by the developing agent supported by a developing sleeve 33A having an applied bias voltage, which is obtained by superimposing an alternating-current component on the direct-current component of a developing device 33, and thus a visible toner image is formed.

Transfer paper P of the specified size is unloaded, sheet by sheet, by a set of unloading rollers 42A from a paper feed cassette 41A or 41B charged within a paper feeding section 40, and then the paper is fed towards the transfer portion of the image via unloading rollers 43 and a guide member 42. Fed transfer paper P is sent onto the photoreceptor drum 31 by resist rollers 44 which operate in synchronization with the toner image on the photoreceptor drum 31. The toner image thereon is transferred to the transfer paper P by the action of a transferring device 34, and after being separated from photoreceptor drum 31 by the discharging action of a separator 35, the transfer paper is sent to a fixing device 37 via a carrying belt 45. Next after being fusion-fixed by a heating roller 37A and a pressurizing roller 37B, the transfer paper is ejected into the external tray of the apparatus by paper ejection rollers 38 and 46.

The above-mentioned photoreceptor drum 31 further continues rotating, and after the toner remaining untransferred on the surface thereof has been cleaned away by a cleaning blade 39A press-fit in a cleaning device 39 and then the photoreceptor drum 31 has been discharged once again by the discharging device 36, the photoreceptor drum 31 is uniformly recharged to advance processing to the next image forming process.

At this time, a two-component developing agent consisting of the styrene-acrylic polymerized toner whose mass mean particle size is 3–8 $\mu$m, and a resin-coated ferrite carrier whose mass mean particle size is 60 $\mu$m, is used to be provided with high resolution and excellent tone reproducibility.

In the image forming apparatus of the present embodiment, between laser writing section 20 and developing device 33 is provided a potential sensor 61 facing the photoreceptor drum 31, and this sensor detects the charging potential that has been assigned by charging device 32, and the potential of the latent image portion which has been exposed by laser writing section 20. Also, downstream with respect to the developing device 33 is provided an image density sensor 62 facing the photoreceptor drum 31 and consisting of a light-emitting element and a light-receiving element, and the image density sensor 62 detects the image density of the image which has been made visible by development. In addition, on the paper feeding route of the transfer paper P is provided a print counter 63 to count the number of prints. Furthermore, developing device 33 is provided with a developing time accumulator 64 (shown in FIG. 2) that accumulates the stirring time of the developing agent, and with an environmental sensor 65 for detecting the internal environmental conditions (temperature and/or humidity) of the apparatus.

<Embodiment 2>

Figure 16:
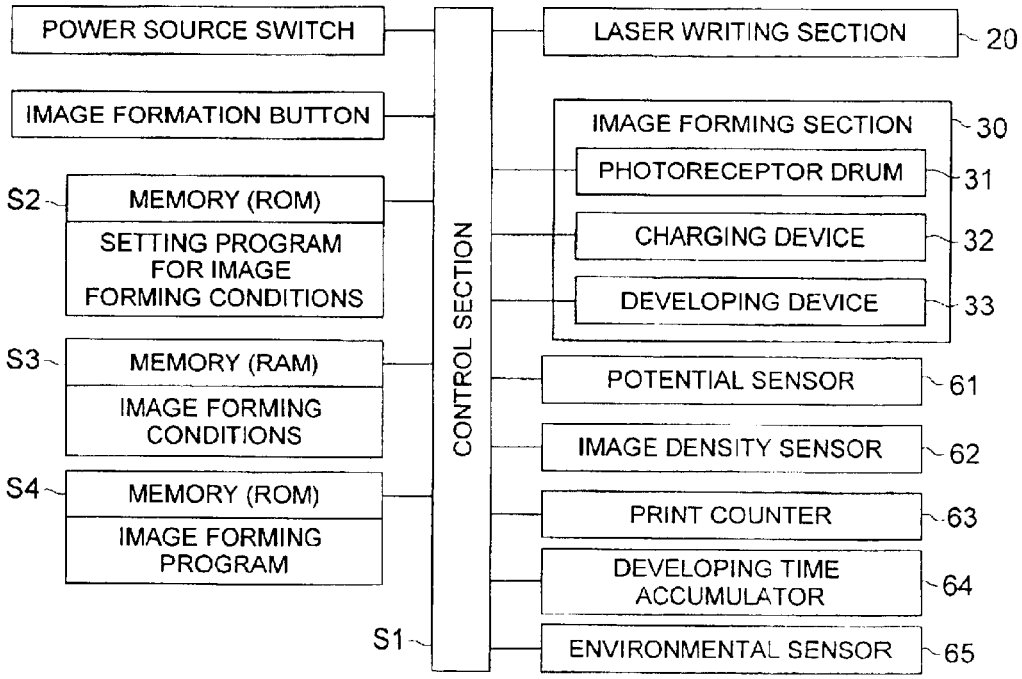
FIG. 16 is a block diagram showing the control of the image forming apparatus under the present embodiment.

(1) FIG. 16 is a block diagram showing the control circuits of the image forming apparatus under the present Embodiment 2. Prior to image formation, a control section S1 calls up an image forming program that has been stored into a memory S4, and executes the image formation through the process described earlier.

In the image forming apparatus of the present embodiment, after the power to the apparatus has been turned on, when control section S1 detects the fact that the ambient temperature of the fixing device 37 is below the required temperature, control section S1 will, during the time that the temperature of the heating roller 37A increases to a predetermined fixing temperature, in other words, during warming-up, set the appropriate image forming conditions by forming a reference control patch in accordance with the image forming conditions setting program that has been stored into memory S2. Next, the method of forming a reference control patch is described below.

1. First, potential correction control of the photoreceptor is conducted. That is to say, a uniform minus electric charge is applied to photoreceptor drum 31 by charging device 32, solid patch imagewise exposure is performed on the uniformly minus-charged photoreceptor drum 31 by laser writing section 20, and the latent image potential $V_L$ of the formed solid patch portion is detected by potential sensor 61. The developing bias voltage value $V_B$ is calculated from the latent image potential $V_L$ of the formed solid patch portion as follows by control section S1:

$$VB=VL-500\ \text{V}$$

where 500 V is a predetermined potential difference (patch density threshold value of the solid portion) and is preset to about 500 V.

Next, the input voltage $V_H$ to the charging grid 32B of the charging device 32 (hereinafter, this voltage is referred to as the charging voltage) is calculated using the following expression:

$$VH=VB-150\ V$$

where 150 V is a predetermined potential difference and is preset to about 150 V.

Figure 17:
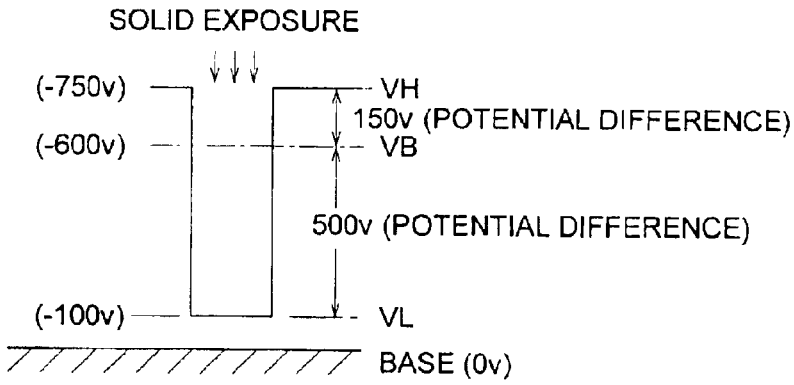
FIGS. 17(*a*) and 17(*b*) are explanatory diagrams showing the potential status of a photoreceptor.
Figure 17:
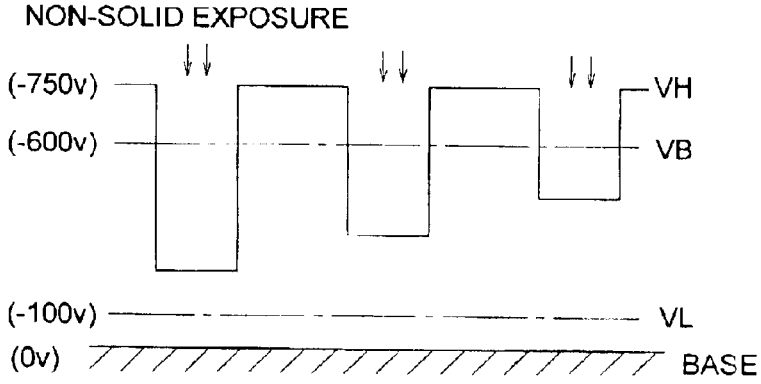

FIG. 17(*a*) is an explanatory diagram showing the relationship involved, wherein, if the latent image potential VL of the solid patch portion is −100 V, the developing bias voltage VB is set to −600 V and the charging voltage $V_H$ is −750 V. Potential adjustments are performed on the charging voltage $V_H$ to be applied to charging device 32, and the developing bias voltage $V_B$ to be applied to developing device 33.

2. The plurality of non-solid control patches shown in FIG. 17(*b*) are formed on photoreceptor drum 31 by modification of image data. Patch images whose densities have been adjusted by means of dither patterns, laser pulse width modulation patterns, or error diffusion patterns, are used for the non-solid patches.

Figure 18:
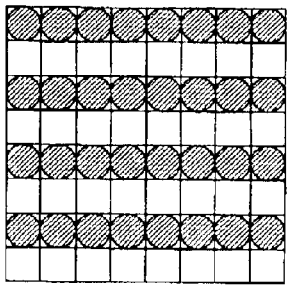
FIGS. 18(*a*) to 18(*f*) show the dither patterns that have been formed with different densities.
Figure 18:
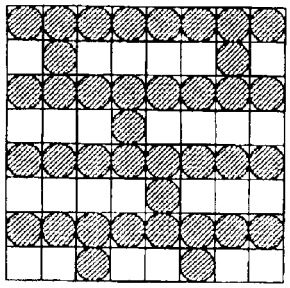
Figure 18:
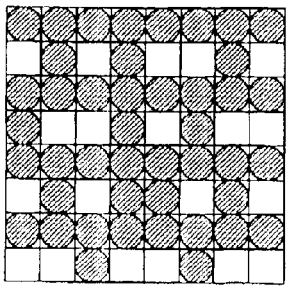
Figure 18:
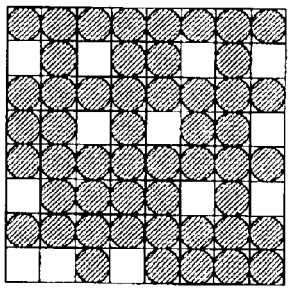
Figure 18:
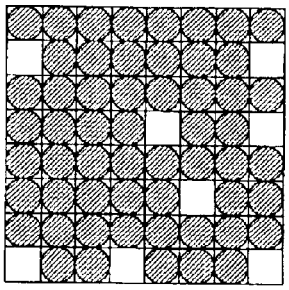
Figure 18:
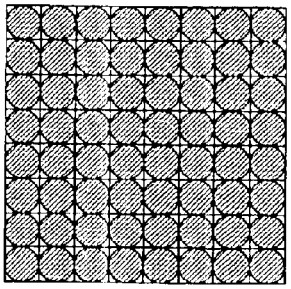

Patches that have been formed using dither patterns different in density are shown in FIGS. 18(*a*) to 18(*f*). The image data densities entered consist of, for example, 256 density levels in steps of eight bits. Dither patterns for output can use the systematic dither method or the random dither method. The densities for representing density levels are represented as probabilities by dither patterns, and therefore since, even in high-density portions, patterns of any density can be formed with high density resolution, highly accurate image density control becomes possible by using dither patterns. The image density of a control patch which is composed of a dither pattern is detected as the average density of the patterns each consisting of a plurality of distributedly existing solid pixels, and a control pattern of multi-level density is formed according to the particular number of distributed solid pixels.

FIGS. 19(*a*) to 19(*f*) shows a patch generated by modulation of the pulse width. When the image data are input in density of 8-bit 256 density levels, a control pattern of multi-level density is formed by one pixel by exposing the output patch with the pulse width divided into 256 levels in one pixel.

In the error diffusion method, which is a developed version of the dither method, the errors that have resulted from pixel processing are allocated to ambient errors and then during processing that follows, the influence is allowed for to minimize the total error rate. The error diffusion method can therefore be used to form non-solid control patches.

3. The potentials of the non-solid control patches which have thus been formed on photoreceptor drum 31 by modifying image data are detected by potential sensor 61. Detected non-solid control patch potentials usually differ from the desired patch potential. The potentials detected change according to environmental conditions (temperature and humidity), the quantity of image formation displayed as the number of prints, and the particular stirring time of the developing agent.

<Environmental Parameters>

The quantity of electric charge on toner changes with environmental parameters, namely, temperature and humidity. Image density, therefore, also changes with changes in environment. The charge holding force of toner decreases under high temperature and high humidity, and as a result, the quantity of electric charge on toner, namely, Q/M (Q: quantity of electric charge, M: mass) decreases. Accordingly, under high temperature and high humidity, image density tends to increase, and events such as fogging or toner scattering, are prone to occur. To perform corrections against these events, when the control patch is to be formed using a dither pattern, the need arises for the number of black pixels in the dither pattern to be provided with modification correction with respect to reference input density. For example, if the environment is split into an HH environment (more than 25° C. in temperature and more than 65% in relative humidity), an NN environment (15–25° C. in temperature and 35–65% in relative humidity), and an LL environment (less than 15° C. in temperature and less than 35% in relative humidity), corrections will be performed to increase the number of black pixels as the environment changes from HH towards LL. Control section S1 will perform such corrections based on the detection signal sent from environmental sensor 65.

<Amount of Image Formation>

As the developing agent is consumed, the electrical charging capability of the carrier will deteriorate and the amount of electric charge on the toner will decrease. Accordingly, as the quantity of image formation increases, more specifically, the number of prints increases, there will occur a greater discrepancy between the density of the control patch and the density of the image actually formed. As the quantity of image formation increases, fogging and toner scattering will also be more prone to occur. The adjustment operation required against these events is, for example, to reduce the density of the control patch according to the particular increase in the quantity of image formation. Such correction is made by control section S1 in accordance with the number of prints that has been counted by print counter 63 as the quantity of image formation. Print counter 63 counts the cumulative number of prints and is initialized when the developing agent in developing device 33 is replaced.

<Stirring Time of the Developing Agent>

Fatigue of the developing agent is caused by the progress of the stirring thereof. Therefore, the fatigue level can be accurately measured by measuring the amount of stirring of the developing agent, instead of the quantity of image formation. More specifically, the fatigue level can be detected by, for example, detecting the cumulative amount of rotation of the stirring screws used as a developing agent stirring means in developing device 33.

In accordance with the detection signal from the developing time accumulator 64 which counts the cumulative amount of rotation of the stirring screws, control section S1 provides arithmetic processing and corrects the number of black pixels in the control patch. The cumulative count of the developing time accumulator 64 is initialized when the developing agent in developing device 33 is replaced.

The above-described image formation control that uses the control patches consisting of non-solid patterns is particularly valid for the image formation that uses polymerized toner. That is to say, polymerized toner is toner manufactured using the method described below, and has the characteristics that because it is small in particle size and because it has a sharp particle size distribution, the toner offers high resolution and excellent tone reproducibility. The application of the present invention to the image forming process that uses polymerized toner enables these characteristics to be fully utilized and images to be formed with stable density and with almost no occurrence of events such as fogging.

<Method of Manufacturing Polymerized Toner>:

Polymerized toner means the toner obtained by creating toner-use binder resin, polymerizing the raw monomer or pre-monomer of the binder resin into toner shape, and subsequent chemical processing. More specifically, polymerized toner means the toner obtained by polymerization such as suspension polymerization or emulsion polymerization, and the fusion of particles that is subsequently conducted as required. Since polymerized toner is manufactured by polymerizing the raw monomer or pre-monomer after these monomers have been uniformly dispersed in a water-containing substance, toner uniform in particle size distribution and in shape can be obtained.

It is desirable that the toner used in the present embodiment should be toner having a small mass mean particle size from 3 to 8 $\mu$m.

The mass mean particle size is a mass-based mean particle size, which is a value measured by the "Coulter Counter TA-II" or "Coulter Multisizer", both having a wet-type dispersion machine and manufactured by Beckman Coulter, Inc.

The difference in patch potential $|V_B-V_P|$ between developing bias $V_B$ and patch potential $V_P$ at a non-solid portion, dictated by the environmental parameters and total print count existing when the patch density threshold value of the solid portion is 550 V, is shown in Table 2.

TABLE 2

| Total Print Count | Temperature/Humidity HH | NH | LL |
|---|---|---|---|
| 0–50 Kc | 490 | 500 | 510 |
| 50–100 Kc | 485 | 495 | 505 |
| 100–200 Kc | 480 | 490 | 500 |
| 200–500 Kc | 475 | 485 | 495 |
| 500–1000 Kc | 470 | 480 | 490 |
| Over 1000 Kc | 465 | 475 | 485 |

Control section S1 calculates $|V_B-V_P|$, the patch density threshold value of the solid portion, from the above table wherein the temperature and humidity that have been detected by environmental sensor 65, and the total number of prints which have been detected and counted by print counter 63 are listed.

Figure 20:
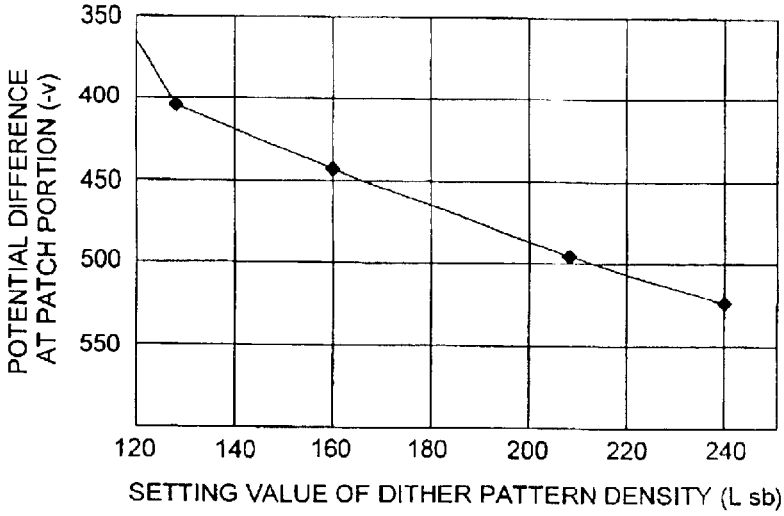
FIG. 20 is a graph showing the relationship between the differential potentials of a patch portion and the density settings of a dither pattern.

FIG. 20 is a graph showing the relationship between the differential potentials of a patch portion and the density settings of a dither pattern. The dither pattern density at which the desired potential can be obtained is calculated from the calculated patch density threshold value by control section S1 by use the graph of FIG. 20.

Control of image formation by using the non-solid control patch of the calculated dither pattern density provides sensitivity correction based on the temperature and humidity of the photoreceptor, and/or correction based on the development history of the developing agent. Consequently, either immediately after the power-on sequence or during the copy sequence, image density is properly adjusted, independently of the environment or of the development history, and stable image formation occurs without significant toner scattering.

Figure 21:
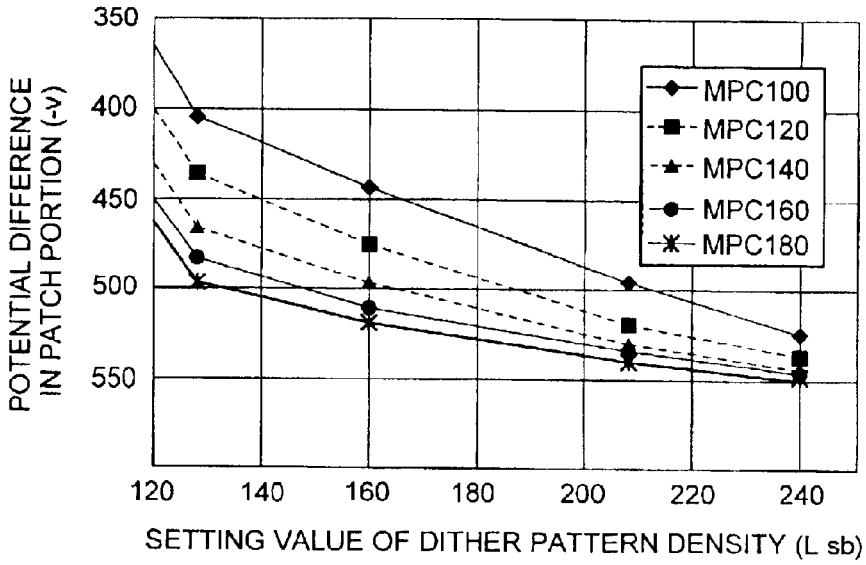
FIG. 21 is a graph showing the relationship between the differential potentials of the patch portions existing when the quantity of laser light is changed, and the density settings of dither patterns.

(2) Shown in FIG. 21 is a graph showing the relationship between the differential potentials of the patch portions existing when the quantity of laser light (MPC) in the laser writing section 20 is changed, and the density settings of dither patterns. The relationship between the differential potential of the patch portion and the density setting of the dither pattern is changed by changing the quantity of laser light. In the present embodiment, therefore, if laser intensity is changed by an operation such as replacing the laser writing section, image forming conditions will be set immediately after the change in the laser intensity, similarly to the case described in Section (1) above. In other words, the dither pattern density threshold value is calculated from a curve of the corresponding amount of laser light (MPC) in FIG. 7 by use the patch density threshold value of the non-solid portion that has been calculated from Table 1, and image formation is controlled using the non-solid control patch of the calculated dither pattern density.

When image formation is thus controlled, since, independently of the environment, the total print count, or the like, the proper adjustment of image density is started immediately from the time that laser intensity has changed, stable image formation almost free from toner scattering occurs.

EXAMPLES 2

In all the comparative samples and embodiments that are described below, tests have been conducted using a copying machine created by modifying the digital copying machine "Konica Sitios 7075" manufactured by the Konica Corporation. The common conditions in the comparative samples and embodiments are listed below.

Photoreceptor: OPC photoreceptor (Drum diameter: 100 mm);
Photoreceptor linear velocity ($V_p$): 400 mm/sec;
Developing sleeve linear velocity ($V_s$): Fixed ($V_s/V_p$=2.0);
Developing agent: Two-component developing agent consisting of the polymerized toner having a mean particle size of 6 $\mu$m, and a carrier having a mean particle size of 60 $\mu$m.

(1) Comparative Sample 3:

A patch formed by modifying the density data settings of a dither patch has been used as the image adjustment patch.

New density setting data has been determined in the following sequence:

1. The potentials of the patch portion at five density setting data points are measured using a potential meter;
2. The relationship between each potential of the patch portion and each density setting value is derived; and
3. The density setting value corresponding to the determined potential of the patch portion is selected.

In accordance with these conditions, 100 Kc (100,000 sheets) of printing has been executed under the LL (Low humidity and Low temperature) environment, the NN (Normal humidity and Normal temperature) environment, and the HH (High humidity and High temperature) environment, and the resulting image density ("$D_{max}$"), toner consumption, image quality, and other factors have been examined.

Evaluations: Immediately after power-on, image density has already been properly adjusted. However, since changes in the internal temperature and humidity of the machine have changed the sensitivity of the photoreceptor and thus changed the patch density existing when the total print count increased, the image density has become unstable and increases in the amount of toner scattering have been observed.

(2) Inventive Sample 5

A patch formed by modifying the measured density data of a dither patch has been used as the image adjustment patch.

New density data has been determined in the following sequence:

1. Photoreceptor potential correction control is executed,

The latent image potential $V_L$ of the solid patch portion is measured and the developing bias voltage and the charging grid input value are adjusted so that the value of (Developing bias voltage $V_B$<Charging voltage $V_H$) becomes equal to the setting, ($V_B=V_L-500$ V, $V_H=V_B-150$ V);

2. The potentials of the patch portion at five density setting data points are measured using a potential meter;
3. The relationship between each potential of the patch portion and each density setting value is derived; and
4. The density setting value corresponding to the determined potential of the patch portion is selected.

In accordance with these conditions, 100 Kc (100,000 sheets) of printing has been executed under the LL environment, the NN environment, and the HH environment, and the resulting image density ("$D_{max}$"), toner consumption, image quality, and other factors have been examined.

Evaluations: Immediately after power-on, image density has already been adjusted during the copy sequence, independently of the environmental conditions. Also, stable and high-quality images almost free from toner scattering have been obtained.

(3) Inventive Sample 6

A patch formed by modifying the measured density data of a dither patch has been used as the image adjustment patch.

New density data has been set when the amount of light from the laser writing section 20 was changed as follows:

1. Laser power is changed;
2. Photoreceptor potential correction control is executed, The latent image potential $V_L$ of the solid patch portion is measured and the developing bias voltage and the charging grid input value are adjusted so that the developing bias voltage value $V_B$ and the charging grid input value become equal to the respective settings, ($V_B=V_L-500$ V, $V_H=V_B-150$ V);

3. The potentials of the patch portion at five density setting data points are measured using a potential meter;
4. The relationship between each potential of the patch portion and each density setting value is derived; and
5. The density setting value corresponding to the determined potential of the patch portion is selected.

In accordance with these conditions, 100 Kc (100,000 sheets) of printing has been executed under the LL environment, the NN environment, and the HH environment, and the resulting image density ("$D_{max}$"), toner consumption, image quality, and other factors have been examined.

Evaluations: Immediately after power-on, image density has already been adjusted during the copy sequence, independently of the environmental conditions. Also, when laser power was changed, image density has stably changed and stable and high-quality images almost free from toner scattering have been obtained.

Under Structures (30) and (31) described above, immediately after power-on, image density is already adjusted during the copy sequence, independently of the environmental conditions and the total print count. Therefore, stable and high-quality images almost free from toner scattering can be obtained.

Under Structure (32) described above, when laser power is changed, since image density also stably changes, it is already adjusted, independently of the environmental conditions and the total print count. Therefore, stable and high-quality images almost free from toner scattering can also be obtained.

In an Embodiment 3 of the present invention, when the relationship between the latent image potential and reference input density of a control patch is to be arithmetically derived by an arithmetic operating means and then the density of the control patch that enables the creation of the required latent image potential is to be derived, the sensitivity of an image forming medium is stored into the storage means of a control means 130 beforehand, and then the threshold data to be used for the foregoing arithmetic operations is changed according to the particular sensitivity of the image forming medium. Next, the development density of the control patch which has been formed in accordance with the threshold data obtained by changing the original threshold data (hereinafter, the new threshold data is referred to as the optimal threshold data) is detected, and finally, the image forming conditions are controlled in accordance with the corresponding density detection signal.

More specifically, an image forming medium electrically charged under predetermined conditions in a predetermined environment (for example, 20° C. in temperature and 50% in humidity) is optically exposed with a predetermined amount of light, then after a decrement in potential from the charging potential in the exposure area (in other words, the area of the control patch) has been detected by a potential sensor 120, the absolute decrement in potential is derived by arithmetic operations, and threshold data (potential data) for selecting the density of the control patch according to the required decrement in potential is changed by adding the required amount of potential to obtain the optimal threshold value. The thus-obtained optimal threshold value is then stored into the storage means of the control means 130 and used as part of the image data for the control patch formed before normal image formation.

In the present embodiment, the decrement in potential from the charging potential (synonymous with the surface potential) on the photoreceptor in the area of the control patch, and the amount of potential to be added are held in the following relationship:

| Absolute decrement in potential | Amount of addition |
|---|---|
| Up to 625 V | −15 V |
| More than 625 V, but up to 635 V | −10 V |
| More than 635 V, but up to 645 V | −5 V |
| More than 645 V, but up to 655 V | 0 V |
| More than 655 V, but up to 665 V | 5 V |
| More than 665 V, but up to 675 V | 10 V |
| More than 675 V | 15 V |

As is obvious from the above, all threshold data is based on an absolute potential decrement of 650 V.

The above-mentioned threshold data can be further changed according to changes in the environment, the number of prints, or the stirring time of the developing agent (history of the developing agent).

In the present embodiment, the threshold data pertaining to the density of the control patch is changed as follows according to, for example, the history of the developing agent and changes in the environment:

| | High humidity | Normal humidity | Low humidity |
|---|---|---|---|
| 0 to 50 Kc | 500 | 505 | 515 |
| More than 50 Kc, but up to 100 Kc | 495 | 500 | 510 |
| More than 100 Kc, but up to 200 Kc | 490 | 495 | 505 |
| More than 200 Kc, but up to 500 Kc | 485 | 490 | 500 |
| More than 500 Kc, but up to 1,000 Kc | 480 | 485 | 495 |
| More than 1,000 Kc | 475 | 480 | 490 |

Each value listed under the above humidity columns is an (Absolute developing bias value−Absolute potential value of the patch portion). For example, when 150 Kc is being used under high humidity for a photoreceptor whose decrement in potential is 668 V, (490 V+10 V=505 V) is the optimal threshold value.

In an Embodiment 4 of the present invention, when the relationship between the latent image potential of a control patch and the reference input density thereof is to be arithmetically derived by an arithmetic operating means and then the density of the control patch that enables the creation of the required latent image potential is to be derived, comparison is made between, for example, the response performance of the writing light from the laser light source to be used, and the response performance of reference writing light that has been stored into the storage means of the control means 130 beforehand. Next after threshold data has been changed according to the particular difference in response performance and then the development density of the control patch formed in accordance with the threshold data obtained by changing the original threshold data (hereinafter, the new threshold data is referred to as the optimal threshold data) has been detected, the image forming conditions are controlled in accordance with the corresponding density detection signal.

The response performance or response characteristics of the writing light here refer to the ratio between the relative average amount of light existing when laser diodes (LDs) are activated with PWM128 (all-LD-on 255) and a 50% ON/OFF duty under the fixed environmental conditions of 20° C. in temperature and 50% in relative humidity, and the amount of light existing when all LDs are on.

The response characteristics can be measured using, for example, the Model AQ1135E optical power meter manufactured by the Ando Electric Co., Ltd.

More specifically, the response performance of the writing light and the response performance of reference writing light are compared, and threshold data is changed by adding fixed data according to the particular difference in the response performance. Thus, the optimal threshold value is derived. The amount of addition is calculated according to the particular relative amount of writing light.

The optimal threshold value is stored into the storage means and used as part of the image data for the control patch formed before normal image formation.

In the present embodiment, the relationship between the relative amount of light and the amount of addition is as follows:

| Difference in the relative amount of light | Amount of addition |
|---|---|
| Up to −0.15 | −15 V |
| Greater than −0.15, but up to −0.1 | −10 V |
| Greater than −0.1, but up to −0.05 | −5 V |
| Greater than −0.05, but up to +0.05 | 0 V |
| Greater than +0.05, but up to +0.1 | 5 V |
| Greater than +0.1, but up to +0.15 | 10 V |
| Greater than +0.15 | 15 V |

The response performance of reference writing light in the present embodiment has been set to 30%.

In the present embodiment, the threshold data pertaining to the density of the control patch is changed as follows according to, for example, the history of the developing agent and changes in the environment:

| | High humidity | Normal humidity | Low humidity |
|---|---|---|---|
| 0 to 50 Kc | 500 | 505 | 515 |
| More than 50 Kc, but up to 100 kc | 495 | 500 | 510 |
| More than 100 Kc, but up to 200 Kc | 490 | 495 | 505 |
| More than 200 Kc, but up to 500 Kc | 485 | 490 | 500 |
| More than 500 Kc, but up to 1,000 kc | 480 | 485 | 495 |
| More than 1,000 Kc | 475 | 480 | 490 |

Each value listed under the above humidity columns is an (Absolute developing bias value−Absolute potential value of the patch portion). For example, when 150 Kc is being used under high humidity for the writing light that creates −0.12 as the difference in the relative amount of light, (490 V−10 V=480 V) is the optimal threshold value.

In addition to or instead of laser diodes, light-emitting diodes (LEDs) can be used as the writing light sources.

EXAMPLES 3

In all the comparative samples and embodiments that are described below, tests have been conducted using a copying machine created by modifying the digital copying machine "Konica Sitios 7075" manufactured by the Konica Corporation.

(1) Comparative Sample 4:

Ratio of Developing sleeve velocity to photoreceptor velocity $V_s/V_p$": 2.0 (set as a fixed value);
Photoreceptor: OPC (diameter: 100 mm);
Photoreceptor linear velocity: 400 mm/sec;
Developing agent: Two-component developing agent consisting of the polymerized toner having a mean particle size of 6 μm, and a carrier having a mean particle size of 60 μm;
Photoreceptor charging potential "$V_s$": −750 V; and
Developing bias "$V_{bias}$": −600 V.

A patch formed by modifying the density data settings of a dither patch has been used as the control patch.

Density data for the control patch has been modified by first creating a latent image of the control patch having a reference input density, then measuring the corresponding potential and deriving the relationship between the potential and density of the patch portion by arithmetic operations, and selecting the density for the control patch so as to match the latent image potential of the patch portion to the desired potential.

While image density control shown in FIGS. 10 and 11 was occurring under the above conditions, 100 k (100,000) sheets have been printed under each of three types of environments (low-humidity, normal-humidity, and high-humidity) to examine image density ("$D_{max}$"), toner consumption, and image quality.

As a result, although the image density existing immediately after power was turned on has already been properly adjusted, since changes in the internal temperature and humidity of the apparatus have changed the sensitivity of the photoreceptor and thus changed the density of the patch with increases in print count, the toner concentration (Tc %) in the developing agent has become unstable and this has made it difficult to obtain prints table in image density and has occasionally increased toner scattering.

(2) Inventive Sample 7

Similarly to the above comparative sample, a patch formed by modifying the density data settings of a dither patch has been used as the control patch.

However, modification of the density data of the control patch differs from the modification in the above comparative sample in that first, photoreceptor potential correction control has been conducted so as to match the developing bias voltage ("$V_{bias}$") and the charging potential ("$V_s$") of the photoreceptor to the respective settings and in that after the temperature of the photoreceptor was measured and stored into a memory during arithmetic operations, the density data of the control patch has been modified (corrected) according to the temperature change of the photoreceptor during printing.

Correction data for temperature changes has obeyed the table shown as a correction diagram in FIG. 7. Other conditions, namely, the developing sleeve−photoreceptor velocity ratio, the size, linear velocity, and type of photoreceptor, and the chemical composition of the developing agent are the same as in the comparative sample.

Under the above conditions, 100 K (100,000) sheets have been printed in each of three types of environments (low-humidity, normal-humidity, and high-humidity) to examine image density ("$D_{max}$"), toner consumption, and image quality.

As a result, despite the environmental changes during printing, the image density existing immediately after power was turned on has already been properly adjusted. Also, image quality has been adequate and stable without significant toner scattering.

(3) Inventive Sample 8:

Similarly to comparative sample 2 and inventive sample 7 above, a patch formed by modifying the density data settings of a dither patch has been used as the control patch.

When the density data of the control patch was modified, photoreceptor potential correction control has been first conducted so as to match the developing bias voltage ("$V_{bias}$") and the charging potential ("$V_s$") of the photoreceptor to the respective settings.

The developing bias voltage and the charging potential of the photoreceptor were initially set so that ($V_{bias}=V_L-500$ V, $V_H=V_{bias}-150$ V), where $V_H$ denotes the charging-applied potential on the photoreceptor and $V_L$ is the potential on the photoreceptor that was applied after uniform exposure under a charged status.

After that, the density data of the control patch has been modified by first creating a latent image of the control patch having a reference input density, then measuring the corresponding potential, deriving the relationship between the potential and density of the patch portion by arithmetic operations, and finally, deriving the optimal threshold value of the patch density under the following conditions:

(Conditions) Fixed data is added to the threshold data for selecting patch density from the photoreceptor sensitivity that was obtained by exposure with a constant amount of light under fixed environmental conditions (20° C. in temperature and 50% in relative humidity).

The amounts of addition are as listed below.

| Absolute decrement in potential | Amount of addition |
|---|---|
| Up to 625 V | −15 V |
| More than 625 V, but up to 635 V | −10 V |
| More than 635 V, but up to 645 V | −5 V |
| More than 645 V, but up to 655 V | 0 V |
| More than 655 V, but up to 665 V | 5 V |
| More than 665 V, but up to 675 V | 10 V |
| More than 675 V | 15 V |

In the corresponding embodiment, threshold data has been modified by further deriving (Absolute developing bias value−Absolute patch potential value) as follows from the developing agent history and the environmental conditions and then adding the results to the above fixed data:

| | High humidity | Normal humidity | Low humidity |
|---|---|---|---|
| 0 to 50 Kc | 500 | 505 | 515 |
| More than 50 Kc, but up to 100 Kc | 495 | 500 | 510 |

-continued

| | High humidity | Normal humidity | Low humidity |
|---|---|---|---|
| More than 100 Kc, but up to 200 Kc | 490 | 495 | 505 |
| More than 200 Kc, but up to 500 Kc | 485 | 490 | 500 |
| More than 500 Kc, but up to 1,000 Kc | 480 | 485 | 495 |
| More than 1,000 Kc | 475 | 480 | 490 |

Other conditions, namely, the ratio of the developing sleeve velocity to the photoreceptor velocity, the size, linear velocity, and type of photoreceptor, and the chemical composition of the developing agent are the same as in the comparative sample 4 and in inventive sample 7.

Under the above conditions, 100 K (100,000) sheets have been printed in each of three types of environments (low-humidity, normal-humidity, and high-humidity) to examine image density ("$D_{max}$"), toner consumption, and image quality.

As a result, despite the environmental changes during printing, the image density existing immediately after power was turned on has already been properly adjusted. Also, image quality has been adequate and stable without significant toner scattering.

(4) Inventive Sample 9

Similarly to comparative sample 4 and inventive samples 7 and 8 above, a patch formed by modifying the density data settings of a dither patch has been used as the control patch.

Similarly to inventive sample 8, when the density data of the control patch was modified, photoreceptor potential correction control has been first conducted so as to match the developing bias voltage ("$V_{bias}$") and the charging potential ("$V_s$") of the photoreceptor to the respective settings.

After that, the density data of the control patch has been modified by first creating a latent image of the control patch having a reference input density, then measuring the corresponding potential, deriving the relationship between the potential and density of the patch portion by arithmetic operations, and finally, deriving the optimal threshold value of the patch density under the following conditions:

<Conditions>: The response performance of the writing light that has been obtained under fixed environmental conditions (20° C. in temperature and 50% in relative humidity), and the response performance of reference writing light are compared, and fixed data is added to threshold data according to the particular difference in the response performance.

The amounts of addition are as listed below.

| Difference in relative amount of light | Amount of addition |
|---|---|
| Up to −0.15 | −15 V |
| Greater than −0.15, but up to −0.1 | −10 V |
| Greater than −0.1, but up to −0.05 | −5 V |
| Greater than −0.05, but up to +0.05 | 0 V |
| Greater than +0.05, but up to +0.1 | 5 V |
| Greater than +0.1, but up to +0.15 | 10 V |
| Greater than +0.15 | 15 V |

In the corresponding inventive sample 9, threshold data has been modified by further deriving (Absolute developing bias value−Absolute patch potential value) as follows from the developing agent history and the environmental conditions and then adding the results to the above fixed data:

| | High humidity | Normal humidity | Low humidity |
|---|---|---|---|
| 0 to 50 Kc | 500 | 505 | 515 |
| More than 50 Kc, but up to 100 Kc | 495 | 500 | 510 |
| More than 100 Kc, but up to 200 Kc | 490 | 495 | 505 |
| More than 200 Kc, but up to 500 Kc | 485 | 490 | 500 |
| More than 500 Kc, but up to 1,000 Kc | 480 | 485 | 495 |
| More than 1,000 Kc | 475 | 480 | 490 |

Under the above conditions, 100 K (100,000) sheets have been printed in each of three types of environments (low-humidity, normal-humidity, and high-humidity) to examine image density ("$D_{max}$"), toner consumption, and image quality.

As a result, despite the environmental changes during printing, the image density existing immediately after power was turned on has already been properly adjusted. Also, image quality has been adequate and stable without significant toner scattering.

Since the threshold data to be used for the arithmetic operations performed to derive the density of the control patch is changed according to the particular change in the sensitivity of the image forming medium, associated with changes in temperature and humidity, or the particular changes in the response characteristics of the writing light, and the image forming conditions are controlled in accordance with the after-development density of the control patch having the density value which has been set in accordance with the modification-obtained optimal threshold data, stable images not affected by changes in, for example, the characteristics of the developing agent can be formed.

What is claimed is:

1. An image forming method comprising the steps of:

(a) forming a plurality of electrostatic latent images of a non-solid control patch having a non-solid pattern by converting image data having reference input densities different from each other;

(b) detecting a patch potential of each of the plurality of electrostatic latent images;

(c) calculating a single density value corresponding to a desired patch potential from the detected plurality of patch potentials;

(d) detecting a density of each of the plurality of non-solid control patches which has been formed by an image-wise exposure according to the single density value of the reference input density obtained by the calculating step; and (e) forming an image by controlling an image forming condition in accordance with a detected density signal.

2. The image forming method of claim 1, wherein the reference input density to be used to form the non-solid pattern is changed according to an environmental parameter.

3. The image forming method of claim 1, wherein the density value of the image data for forming the non-solid pattern is changed according to an amount of image formation.

4. The image forming method of claim 1, wherein the density value of the image data for forming the non-solid pattern is changed according to a period of stirring time of the developing agent.

5. The image forming method of claim 1, wherein the calculating step is conducted each time a predetermined number of images is formed.

6. The image forming method of claim 1, wherein the calculating step is conducted for each predetermined period of a developing agent stirring time.

7. The image forming method of claim 1, further comprising the steps of:

imagewise exposing a solid patch onto the image forming body which has been electrically charged to a potential by a charging device; and adjusting a potential between the latent image potential of the solid patch and a developing bias.

8. The image forming method of claim 7, wherein the non-solid patch is formed by a dither pattern.

9. The image forming method of claim 7, wherein the non-solid patch is formed by an error diffusion pattern.

10. The image forming method of claim 7, wherein the non-solid patch is formed by a pulse width modulation pattern.

11. The image forming method of claim 1, further comprising the steps of:

detecting a temperature on the image forming body by a temperature detector; and storing the temperature into a memory, wherein when a temperature of the image forming body during a formation of the non-solid control patch having a density is changed with respect to the temperature stored in the memory, the density of the non-solid control patch is changed according to an amount of change in the temperature of the image forming body.

12. The image forming method of claim 11, wherein the non-solid control patch is formed by a dither pattern.

13. The image forming method of claim 11, wherein the non-solid control patch is formed by an error diffusion pattern.

14. The image forming method of claim 11, wherein the non-solid control patch is formed by a laser pulse width modulation pattern.

15. The image forming method of claim 11, wherein the density of the control patch that is changed according to the change in temperature is further changed according to a change in an environmental condition.

16. The image forming method of claim 1, wherein a threshold value to be used for a calculation of a relation between a latent image potential of the non-solid control patch and the reference input density is changed according to a sensitivity of the image forming body that has been stored into a memory beforehand.

17. The image forming method of claim 16, wherein the control patch is formed by a dither pattern.

18. The image forming method of claim 16, wherein the control patch is formed by an error diffusion pattern.

19. The image forming method of claim 16, wherein the control patch is formed by a laser pulse width modulation pattern.

20. The image forming method of claim 16, wherein a threshold value to obtain the density of the non-solid control patch is changed according to a change in an environmental condition.

21. The image forming method of claim 16, wherein a threshold value to obtain the density of the non-solid control patch is changed according to the number of images to be printed.

22. The image forming method of claim 16, wherein a threshold value to obtain the density of the non-solid control patch is changed according to a stirring time of the developing agent.

23. The image forming method of claim 1, wherein a threshold data to be used a calculation of a relation between a latent image potential of the non-solid control patch and the reference input density is changed according to a response characteristics of the writing light that have been stored into a memory beforehand.

24. The image forming method of claim 23, wherein the control patch is formed by a dither pattern.

25. The image forming method of claim 23, wherein the control patch is formed by an error diffusion pattern.

26. The image forming method of claim 23, wherein the control patch is formed by a laser pulse width modulation pattern.

27. The image forming method of claim 23, wherein a threshold value to obtain the density of the non-solid control patch is changed according to a change in an environmental condition.

28. The image forming method of claim 23, wherein a threshold value to obtain the density of the non-solid control patch is changed according to the number of images to be printed.

29. The image forming method of claim 23, wherein a threshold value to obtain the density of the non-solid control patch is changed according to a stirring time of the developing agent.

30. The image forming method of claim 23, wherein polymerized toner is used for the development.

31. An image forming method comprising:

(a) forming a control patch by imagewise exposing on the basis of image data of a reference input density;

(b) detecting a density of the control patch; and (c) forming an image by controlling an image forming condition in accordance with the detected signal, wherein the control patch is formed by a dither pattern, wherein the reference input density for forming the dither pattern is changed according to an environmental parameter.

32. The image forming method of claim 31, wherein the reference input density for forming the dither pattern is changed according to an amount of image formation.

33. The image forming method of claim 31, wherein the reference input density for forming the dither pattern is changed according to a stirring period of time of the developing agent.

34. The image forming method of claim 31, wherein a developing agent carrying velocity of a developing agent carrying body is made variable, and a reference value of the developing agent carrying velocity has been set, when the developing agent carrying velocity is less than the reference value, an image density adjustment is accomplished by changing the developing agent carrying velocity, and when the developing agent carrying velocity reaches the reference value, the image density adjustment is accomplished by replenishing toner to the developing device.

35. The image forming method of claim 31, wherein polymerized toner is used for development.

36. An image forming method comprising the steps of:

(a) detecting an image density of a control patch which has been formed on an image forming body; and (b) conducting a first image density control before or after an image forming process and a second image density control during the image forming process in accordance with the detected image density, wherein a dither pattern is used as the control patch.

37. The image forming method of claim 36, wherein the step of conducting the first image density control includes conducting when power is supplied to an image forming apparatus.

38. The image forming method of claim 36, wherein the step of conducting the first image density control includes conducting at a fixed time interval under a stand-by status.

39. The image forming method of claim 36, wherein the step of conducting the first image density control includes conducting at each predetermined time.

40. The image forming method of claim 36, wherein the detecting steps of the control patch under the first image density control, and under the second image density control include conducting by a same image density detector.

41. The image forming method of claim 36, wherein during the second image density control, toner is replenished each time a predetermined number of images are formed.

42. The image forming method of claim 36, wherein polymerized toner is used for development.

43. An image forming apparatus comprising:

(a) an image forming body;

(b) a latent image forming device for forming an electrostatic latent image on the image forming body in accordance with image data;

(c) a developing device having a developing agent carrying body for forming a toner image by developing the electrostatic latent image formed on the image forming body;

(d) a toner replenisher for replenishing toner to the developing device;

(e) an image density detector for detecting an image density of the toner image formed on the image forming body; and (f) a controller for forming a control patch on the image forming body by controlling the latent image forming device and controlling an image forming condition in accordance with an output of the image density detector which has detected the image density of the control patch, wherein the control patch is formed by a patch having a non-solid pattern, and wherein a density value of the image data for forming the non-solid pattern is changed according to an environmental parameter.

44. The image forming apparatus of claim 43, wherein when a developing agent carrying velocity of the developing agent carrying body is less than a reference value, the controller executes a first image density control to adjust the carrying velocity, and when the carrying velocity reaches the reference value, the controller executes a second image density control to replenish toner by the toner replenisher without adjusting the carrying velocity.

45. The image forming apparatus of claim 43, wherein a density value of the image data for forming the non-solid pattern is changed according to an amount of image formation.

46. The image forming apparatus of claim 43, wherein a density value of the image data for forming the non-solid pattern is changed according to a stirring period of time of the developing agent.

47. The image forming apparatus of claim 43, wherein the controller controls to form the control patch having the dither pattern when a first image density control executed before or after an image forming process, and a second image density control executed during the image forming process are conducted.

48. The image forming apparatus of claim 47, wherein when power is supplied to the image forming apparatus, the controller executes the first image density control.

49. The image forming apparatus of claim 47, wherein the controller executes the first image density control at a fixed time interval under a stand-by status.

50. The image forming apparatus of claim 47, wherein the controller executes the first image density control at each predetermined time.

51. The image forming apparatus of claim 47, wherein during the second image density control, the controller replenishes toner each time a predetermined number of images are formed.

52. The image forming apparatus of claim 43, further comprising:

an electrical charging device for charging the image forming body;

an imagewise exposure device for imagewise exposing based on the image data and enabling an adjustment of an amount of light necessary to form the electrostatic latent image on the image forming body;

a potential measuring device for measuring a potential on the image forming body;

a potential sensor for detecting a potential of each of a plurality of non-solid patches which have been formed on the image forming body by modifying image data; and a calculator for calculating detected potentials to obtain a single desired patch potential, wherein the developing device forms the toner image by applying a developing bias and reversal-developing the electrostatic latent image on the image forming body, wherein the controller forms the toner image by detecting the obtained density of the non-solid patches, and controls image forming conditions on the basis of a detected signal.

53. The image forming apparatus of claim 52, wherein the controller forms the image immediately after changing intensity of the imagewise exposure device.

54. The image forming apparatus of claim 52, wherein polymerized toner is used in the developing device.

55. The image forming apparatus of claim 52, further comprising:

a memory for storing a density of the control patch;

a temperature detector for detecting a temperature of the image forming body during a calculation to obtain the density corresponding to a predetermined latent image potential; and a temperature memory for storing the temperature that has been detected by the temperature detector, wherein the controller controls the image forming a condition by first judging whether the temperature of the image forming body during the formation of the control patch in a copy sequence changes with respect to the temperature of the image forming body during the calculation on the density of the control patch, next changing the density of the control patch according to a difference between the two temperatures, then developing the latent image that has been exposed to light so as to achieve an optimal control patch density, and finally receiving the density signal corresponding to the toner density of the control patch detected by the density detector.

56. The image forming apparatus of claim 55, wherein the control patch is formed by either one of a dither pattern, an error diffusion pattern, and a laser pulse width modulation pattern.

57. The image forming apparatus of claim 55, further comprising a sensitivity memory for storing a sensitivity of the image forming body beforehand, wherein a threshold value to be used for the calculation performed by a calculator to obtain the density of the control patch is changed according to the sensitivity of the image forming body that has been stored into the sensitivity memory.

58. The image forming apparatus of claim 55, further comprising a storage device for storing beforehand a response characteristics of a writing light of a writer constituting the latent image forming device, wherein a threshold value to be used for the calculation performed by a calculator to obtain the density of the control patch is changed according to the response characteristics of the writing light that have been stored into the storage device.

59. The image forming apparatus of claim 55, wherein polymerized toner is used in the developing device.

* * * * *